US011565905B2

(12) United States Patent
Shibasaki et al.

(10) Patent No.: US 11,565,905 B2
(45) Date of Patent: Jan. 31, 2023

(54) CUTTING DEVICE, POST-PROCESSING APPARATUS, AND IMAGE FORMING SYSTEM

(71) Applicants: Yuusuke Shibasaki, Kanagawa (JP); Yuji Suzuki, Kanagawa (JP)

(72) Inventors: Yuusuke Shibasaki, Kanagawa (JP); Yuji Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/226,217

(22) Filed: Apr. 9, 2021

(65) Prior Publication Data

US 2021/0316955 A1 Oct. 14, 2021

(30) Foreign Application Priority Data

Apr. 14, 2020 (JP) ..... JP2020-072583

(51) Int. Cl.
*B65H 35/00* (2006.01)
*B65H 43/00* (2006.01)

(52) U.S. Cl.
CPC ..... *B65H 35/0086* (2013.01); *B65H 43/00* (2013.01)

(58) Field of Classification Search
None
See application file for complete search history.

(56) References Cited

U.S. PATENT DOCUMENTS

| | | | | |
|---|---|---|---|---|
| 6,341,548 | B1 * | 1/2002 | Hirahata | B26D 7/2628 83/881 |
| 7,802,789 | B2 * | 9/2010 | Tokita | B26F 1/0092 271/265.01 |
| 10,261,461 | B2 * | 4/2019 | Kobayashi | B26D 9/00 |
| 10,562,731 | B2 * | 2/2020 | Nakano | B26F 1/02 |
| 2005/0051011 | A1 * | 3/2005 | Onishi | B26D 11/00 83/563 |
| 2015/0360899 | A1 | 12/2015 | Takahashi et al. | |
| 2016/0060072 | A1 | 3/2016 | Watanabe et al. | |
| 2016/0068359 | A1 | 3/2016 | Suzuki et al. | |
| 2016/0114999 | A1 | 4/2016 | Suzuki et al. | |
| 2016/0340144 | A1 | 11/2016 | Sakano et al. | |
| 2016/0340145 | A1 | 11/2016 | Kunieda et al. | |
| 2016/0360053 | A1 | 12/2016 | Suzuki et al. | |
| 2017/0174465 | A1 | 6/2017 | Morinaga et al. | |

(Continued)

FOREIGN PATENT DOCUMENTS

| | | |
|---|---|---|
| JP | 2015-123522 | 7/2015 |
| JP | 2017-104915 | 6/2017 |

*Primary Examiner* — Leslie A Nicholson, III
(74) *Attorney, Agent, or Firm* — Harness, Dickey & Pierce, P.L.C.

(57) ABSTRACT

A cutting device is configured to cut, in an arc shape, an end of a sheet conveyed in a conveyance direction. The cutting device includes an arc-shaped cutting blade; a switching mechanism; and a contact-and-separation mechanism. The switching mechanism is configured to switch a posture of the cutting blade in accordance with a position of the sheet facing the cutting blade. The contact-and-separation mechanism is configured to bring the cutting blade into contact with the sheet in a contact direction orthogonal to a surface of the sheet and away from the sheet in a separation direction opposite the contact direction, to cut the end of the sheet in the arc shape.

16 Claims, 30 Drawing Sheets

(56) References Cited

U.S. PATENT DOCUMENTS

| | | | |
|---|---|---|---|
| 2017/0217239 | A1 | 8/2017 | Suzuki et al. |
| 2017/0305706 | A1 | 10/2017 | Takahashi et al. |
| 2018/0236744 | A1 | 8/2018 | Suzuki et al. |
| 2018/0257900 | A1 | 9/2018 | Suzuki et al. |
| 2018/0259895 | A1 | 9/2018 | Shibasaki et al. |
| 2019/0010011 | A1 | 1/2019 | Watanabe et al. |
| 2020/0140222 | A1 | 5/2020 | Takahashi et al. |
| 2020/0270093 | A1 | 8/2020 | Suzuki et al. |
| 2020/0307936 | A1 | 10/2020 | Sugawara et al. |
| 2020/0307944 | A1 | 10/2020 | Shibasaki et al. |
| 2020/0307945 | A1 | 10/2020 | Mori et al. |
| 2021/0039900 | A1 | 2/2021 | Shimazu et al. |

* cited by examiner

CUTTING DEVICE, POST-PROCESSING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2020-072583, filed on Apr. 14, 2020, in the Japan Patent Office, the entire disclosure of which is incorporated by reference herein.

BACKGROUND

Technical Field

Embodiments of the present disclosure relate to a cutting device, a post-processing apparatus, and an image forming system.

Related Art

There has been known a post-processing apparatus that performs post-processing on a sheet on which an image is formed by an image forming apparatus. Specific examples of post-processing include a punching process for punching holes in sheets, an end stitching process for bundling a plurality of sheets and stitching their ends, a saddle stitching process for performing saddle stitching, and a chamfering process for chamfering the ends of the sheets.

There is a known a configuration of a post-processing apparatus that performs a chamfering process, where a pair of cutting blades separated in the width direction orthogonal to the sheet conveying direction are projected toward the sheet to cut the ends of the sheet with respect to the width direction in an arc shape (hereinafter, described as "chamfering").

SUMMARY

In an aspect of the present disclosure, there is provided a cutting device is configured to cut, in an arc shape, an end of a sheet conveyed in a conveyance direction. The cutting device includes an arc-shaped cutting blade; a switching mechanism; and a contact-and-separation mechanism. The switching mechanism is configured to switch a posture of the cutting blade in accordance with a position of the sheet facing the cutting blade. The contact-and-separation mechanism is configured to bring the cutting blade into contact with the sheet in a contact direction orthogonal to a surface of the sheet and away from the sheet in a separation direction opposite the contact direction, to cut the end of the sheet in the arc shape.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION OF EMBODIMENTS

Figure 1:
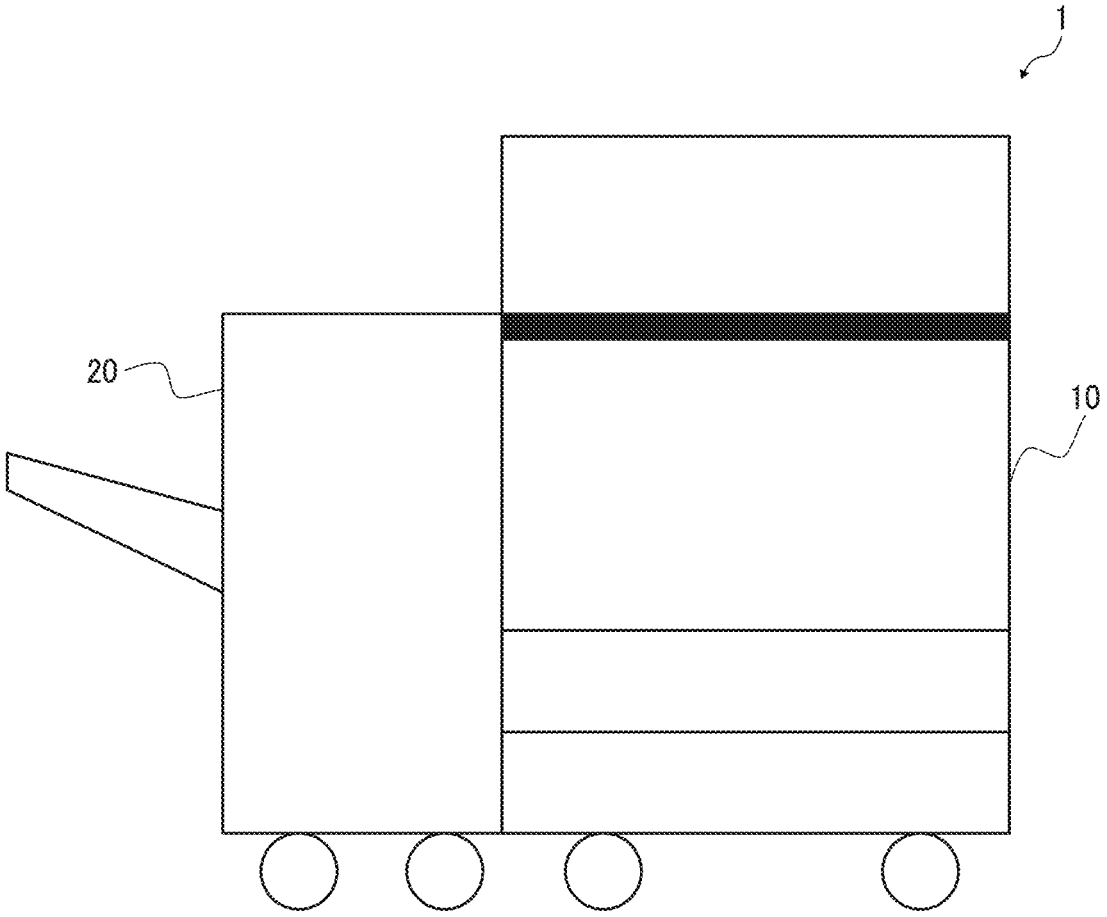
FIG. 1 is a side view illustrating an overall outline of an image forming system according to a first embodiment.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results. Although the embodiments are described with technical limitations with reference to the attached drawings, such description is not intended to limit the scope of the disclosure and all of the components or elements described in the embodiments of this disclosure are not necessarily indispensable. Referring now to the drawings, embodiments of the present disclosure are described below. In the drawings for explaining the following embodiments, the same reference codes are allocated to elements (members or components) having the same function or shape and redundant descriptions thereof are omitted below.

First Embodiment

Hereinafter, an image forming system 1 according to the first embodiment will be described with reference to the drawings. FIG. 1 is a side view illustrating an overall outline of the image forming system 1 according to the first embodiment. The image forming system 1 continuously forms an image on a plurality of sheets M. As illustrated in FIG. 1, the image forming system 1 mainly includes an image forming apparatus 10 and a post-processing apparatus 20.

The sheets M as sheet-like media refer to every medium to which ink or toner are stuck to form an image and that can be conveyed in a curved form, such as paper (paper sheets), overhead projector (OHP) sheets, threads, fibers, cloth, leather, metal, or plastic.

The image forming apparatus 10 forms an image on the sheets M. Then, the image forming apparatus 10 discharges the sheets M on which the image is formed to the post-processing apparatus 20. The image forming apparatus 10 mainly includes a paper feeding tray as a sheet accommodating unit that accommodates the plurality of sheets M in a stacked state, a conveyance unit as a sheet paper feeding/conveyance unit, and an image forming unit that forms an image on the sheets conveyed by the conveyance unit.

The conveyance unit feeds the sheets M contained in the paper feed tray and conveys the sheets M along a conveyance path provided inside the image forming apparatus 10. The conveyance path is a path from the paper feed tray to the post-processing apparatus 20 through a position facing the image forming unit. The image forming unit forms an image on the sheets conveyed by the conveyance unit. The specific configuration of the image forming unit is not particularly limited, and may be an inkjet type or an electrophotographic type.

The post-processing apparatus 20 performs post-processing on the sheets M on which the image is formed by the image forming apparatus 10. The post-processing apparatus 20 according to the present embodiment performs at least a chamfering process in which to cut the ends of the sheets M in an arc shape (hereinafter, referred to as "chamfering"). However, the post-processing executed by the post-processing apparatus 20 is not limited to the chamfering process but may include a punching process for punching holes in the sheets, an end stitching process for bundling a plurality of sheets and stitching the ends of the sheets, and a saddle stitching for performing saddle stitching.

Figure 2:
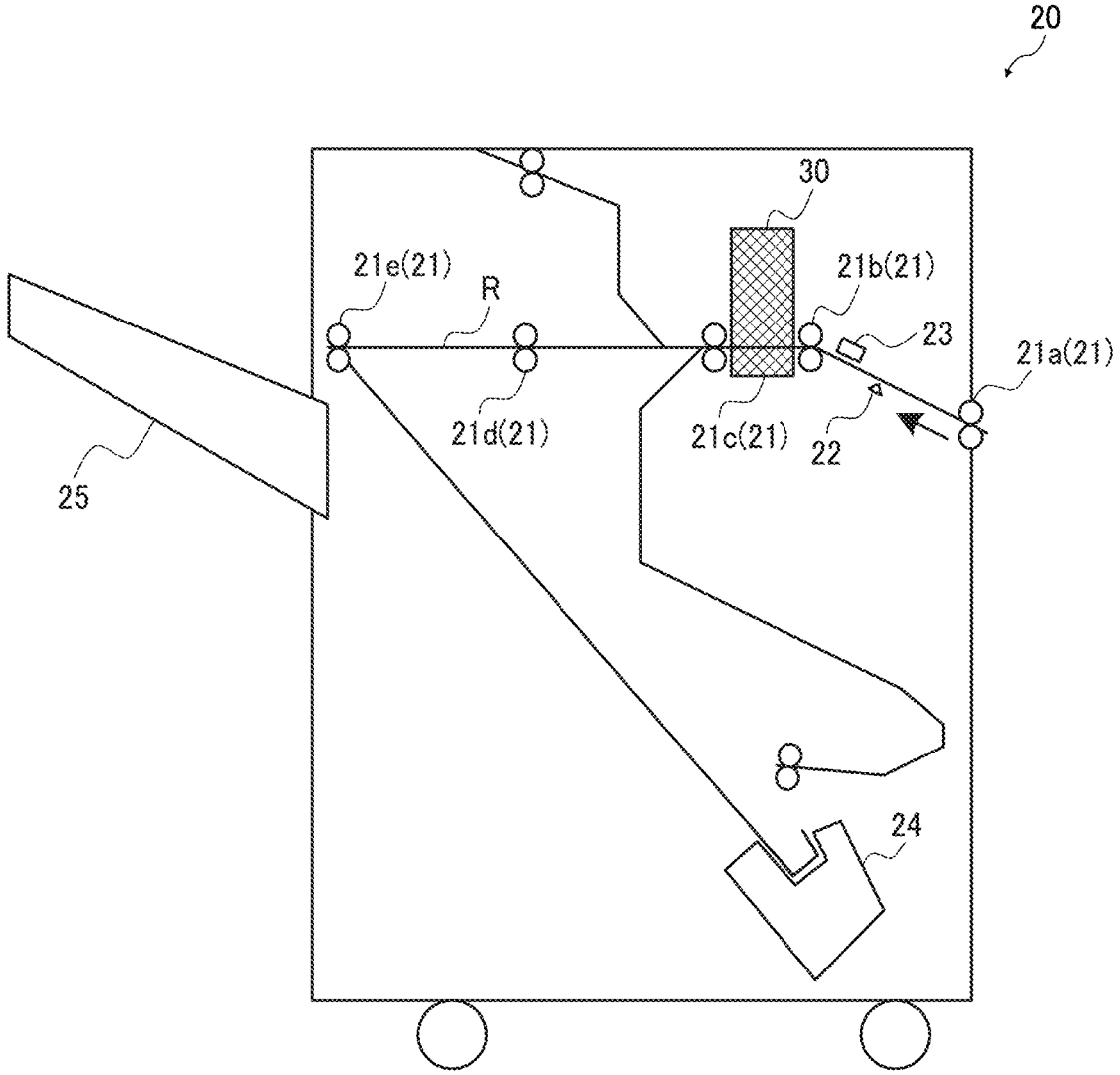
FIG. 2 is a schematic view illustrating an internal structure of a post-processing apparatus.

FIG. 2 is a schematic view illustrating an internal structure of the post-processing apparatus 20. As illustrated in FIG. 2, the post-processing apparatus 20 mainly includes a conveyance unit 21 as a conveyor, a reference sensor 22, a line sensor 23, an end stitching machine 24, a paper ejection tray 25, and a cutting device 30 (chamfering device).

The conveyance unit 21 conveys the sheets M supplied from the image forming apparatus 10 along a conveyance path R inside the post-processing apparatus 20. One end of the conveyance path R is connected to the image forming apparatus 10, and the other end is connected to the paper ejection tray 25 via positions facing the reference sensor 22, the line sensor 23, and the cutting device 30.

The conveyance unit 21 includes a plurality of roller pairs 21*a*, 21*b*, 21*c*, 21*d*, and 21*e*. The roller pairs 21*a* to 21*e* are arranged along the conveyance path R. Each of the roller pairs 21*a* to 21*e* includes a driving roller that rotates with the driving force of a motor and a driven roller that is driven by the rotation of the driving roller. The driving roller and the driven roller rotate with the sheet M sandwiched therebetween to convey the sheet along the conveyance path R in the conveyance direction (direction from the image forming apparatus 10 toward the paper ejection tray 25).

The roller pair 21*a* is arranged on the upstream side of the reference sensor 22 and the line sensor 23 in the conveyance direction. The roller pair 21*b* is arranged on the downstream side of the reference sensor 22 and the line sensor 23 in the conveyance direction, and on the upstream side of the cutting device 30 in the conveyance direction. The roller pair 21*c* is arranged on the downstream side of the cutting device 30 in the conveyance direction. The roller pair 21*d* is arranged on the downstream side of the roller pair 21*c* in the conveyance direction. The roller pair 21*e* is arranged on the downstream side of the roller pair 21*d* in the conveyance direction.

The reference sensor 22 is arranged on the downstream side of the roller pair 21*a* in the conveyance direction and on the upstream side of the line sensor 23 in the conveyance direction. The reference sensor 22 detects that the sheet M has passed the installation position, and outputs a detection signal indicating the detection result to the controller 100 (see FIG. 9) described later. More particularly, the reference sensor 22 does not output a detection signal when the sheet M is not present at the installation position (hereinafter, this state will be referred to as "reference sensor 22 is OFF"). On the other hand, the reference sensor 22 outputs a detection signal when the sheet M is present at the installation position (hereinafter, this state will be referred to as "reference sensor 22 is ON").

That is, the reference sensor 22 starts outputting the detection signal at the timing when the front end of the sheet M reaches the installation position. In other words, when the front end of the sheet M reaches the installation position, the reference sensor 22 switches from OFF to ON. On the other hand, the reference sensor 22 stops the output of the detection signal at the timing when the rear end of the sheet M passes the installation position. In other words, when the rear end of the sheet M passes the installation position, the reference sensor 22 switches from ON to OFF.

The line sensor 23 is arranged on the downstream side of the reference sensor 22 in the conveyance direction and on the upstream side of the roller pair 21*b* in the conveyance direction. The line sensor 23 is arranged too far to one side from the center of the conveyance path R in the width direction orthogonal to the conveyance direction. Then, the line sensor 23 detects the end face position of the sheet M in the width direction conveyed along the conveyance path R, and outputs a detection signal indicating the detection result to the controller 100.

More particularly, the line sensor 23 includes a plurality of sensors arranged in the width direction. Among the plurality of sensors, the sensor facing the sheet M outputs a detection signal, and the sensor not facing the sheet M does not output a detection signal. That is, the controller 100 can determine the boundary position between the sensor that outputs the detection signal and the sensor that does not output the detection signal as the end face position of the sheet M in the width direction.

The specific configurations of the reference sensor 22 and the line sensor 23 are not particularly limited, but for example, a transmission type optical sensor and a reflection type optical sensor can be adopted.

The end stitching machine 24 executes an end stitching process of bundling a plurality of sheets M and stitching the ends of the sheets M. When the roller pair 21*e* sandwiching the sheet M therebetween reversely rotates, the sheet M is supplied to the end stitching machine 24. The end stitching machine 24 bundles the plurality of sheets M supplied by the roller pair 21*e* and stitches the ends of the sheets M. The paper ejection tray 25 stacks and supports the sheets M discharged from the roller pair 21*e*.

Figure 3:
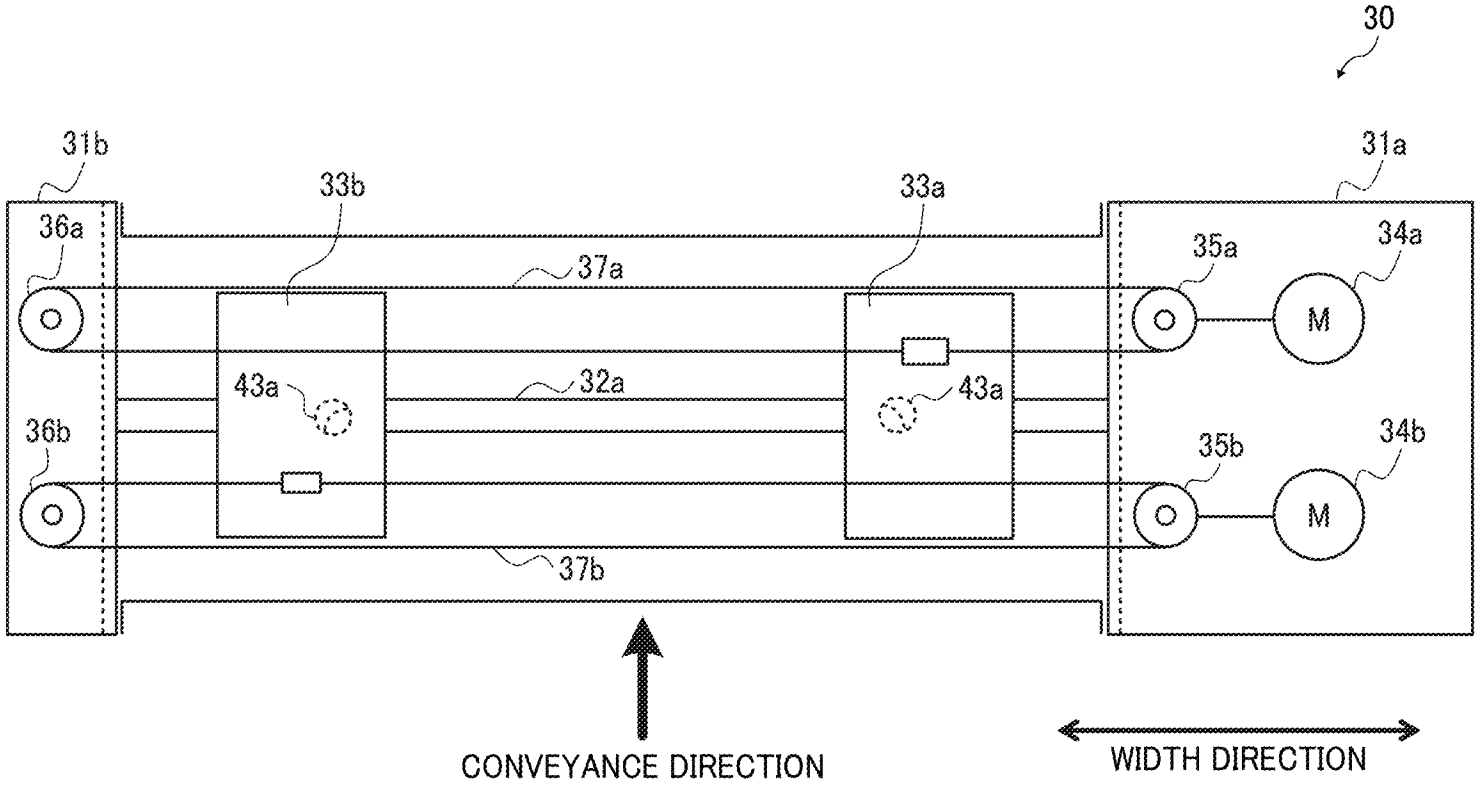
FIG. 3 is a plan view of a cutting device according to the first embodiment.
Figure 4:
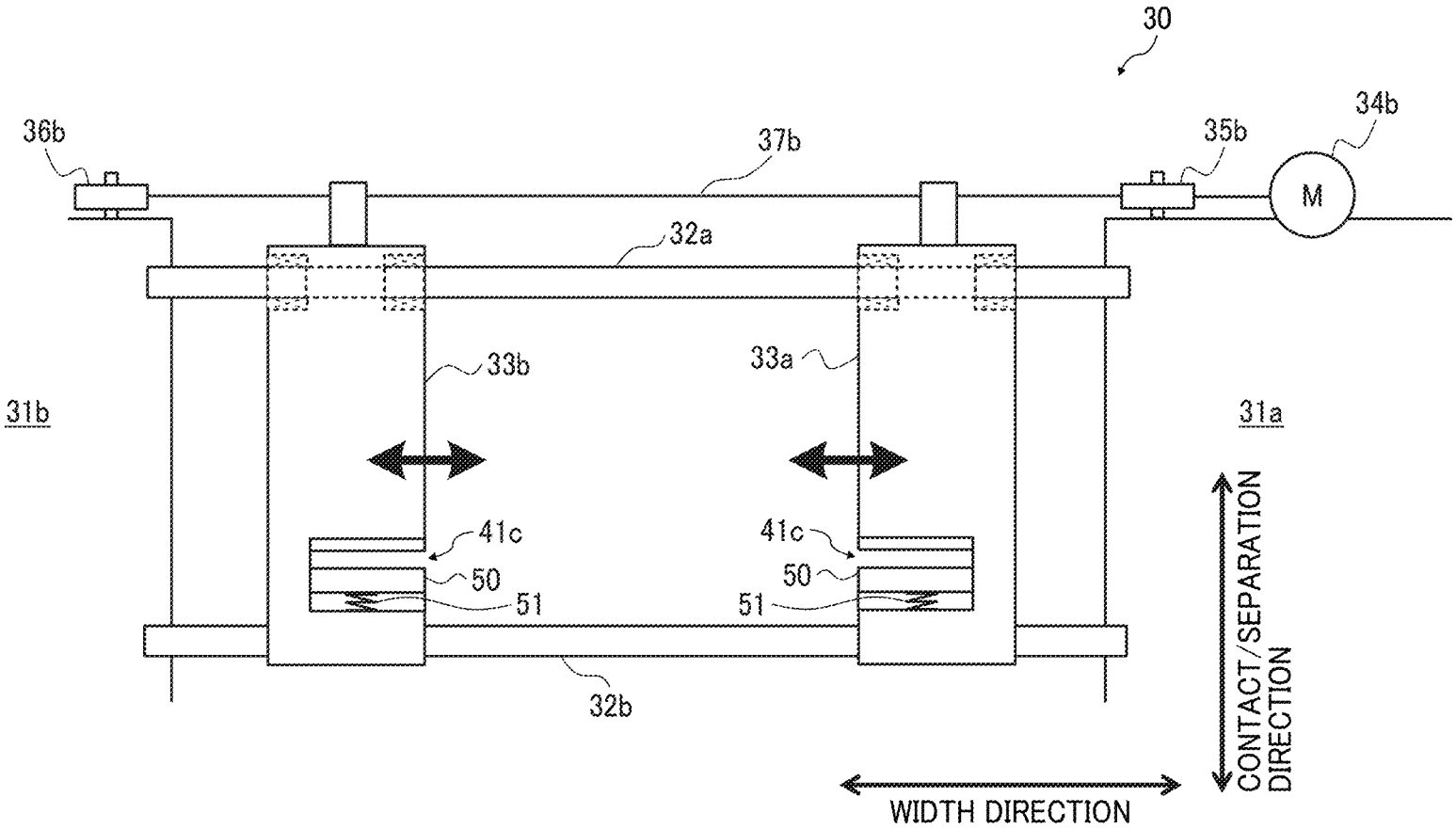
FIG. 4 is a view of the cutting device according to the first embodiment as viewed from the conveyance direction.
Figure 5:
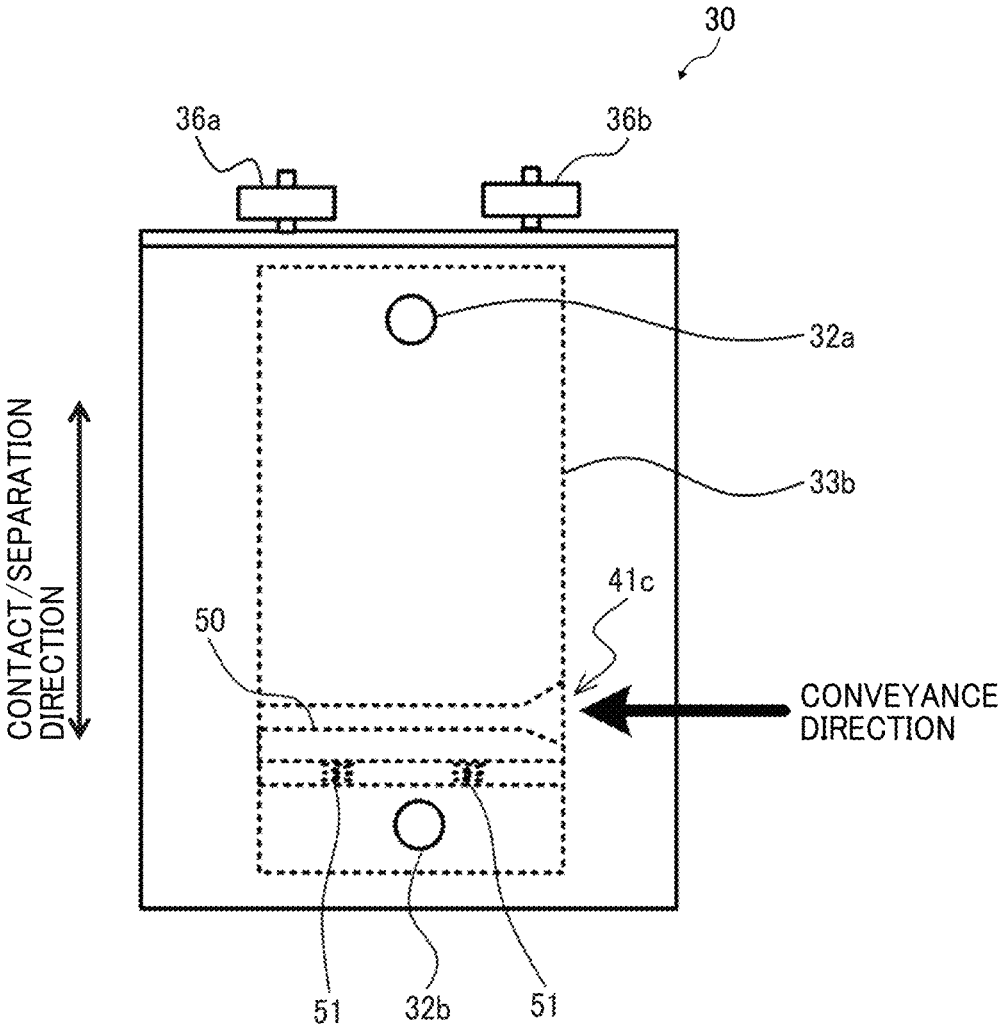
FIG. 5 is a view of the cutting device according to the first embodiment as viewed from the width direction.

FIG. 3 is a plan view of the cutting device 30 according to the first embodiment. FIG. 4 is a view of the cutting device 30 according to the first embodiment as viewed from the conveyance direction. FIG. 5 is a view of the cutting device 30 according to the first embodiment as viewed from the width direction. The cutting device 30 is a device that cuts the end portions of the sheet M conveyed by the conveyance unit 21 in an arc shape. Here, the end portion of the sheet M refers not only to the four corners of the sheet M but also to an arbitrary position on sides constituting the outer shape of the sheet M.

In this specification, the left and right sides are defined so as to face the downstream side in the conveyance direction of the sheet M. In the first embodiment, the "right end" in FIG. 3 is an example of "one end", and the "left end" in FIG. 3 is an example of "the other end". Further, in the first embodiment, the "vertical direction" is an example of the "contact or separation direction" orthogonal to the surface of the sheet M. However, each direction is not limited to the above-mentioned example.

As illustrated in FIGS. 3 to 5, the cutting device 30 mainly includes side plates 31*a* and 31*b*, guide shafts 32*a* and 32*b*, cutting units 33*a* and 33*b*, moving motors 34*a* and 34*b*, driving pulleys 35*a* and 35*b*, driven pulleys 36*a* and 36*b*, and timing belts 37*a* and 37*b*.

The side plates 31*a* and 31*b* are supported by the frame of the post-processing apparatus 20. The side plates 31*a* and 31*b* are arranged so as to sandwich the conveyance path R at positions separated in the width direction. That is, the sheet M conveyed in the conveyance path R passes between the side plates 31*a* and 31*b*.

The guide shafts 32*a* and 32*b* each have one end supported by the side plate 31*a*, and the other end supported by the side plate 31*b*, and extend in the width direction. The guide shafts 32*a* and 32*b* are arranged so as to sandwich the conveyance path R at positions separated in the vertical direction. That is, the sheet M conveyed in the conveyance path R passes between the guide shafts 32*a* and 32*b*.

The cutting units 33*a* and 33*b* are units that cut the end portion of the sheet M in an arc shape. The cutting units 33*a* and 33*b* are supported by the guide shafts 32*a* and 32*b* and are movable in the width direction. The cutting unit 33*a* is arranged on one end side in the width direction (on the right side in the example of FIG. 3). The cutting unit 33*b* is arranged on the other end side in the width direction (left side in the example of FIG. 3). The configurations of the cutting units 33*a* and 33*b* will be described later with reference to FIGS. 6 to 8.

The moving motors 34*a* and 34*b* generate a driving force for moving the cutting units 33*a* and 33*b* in the width direction. The driving pulleys 35*a* and 35*b* are supported by the side plate 31*a*, and are rotated with the transferred driving force of the moving motors 34*a* and 34*b*. The driven pulleys 36*a* and 36 are supported by the side plate 31*b*, and are rotated with the driving force of the moving motors 34*a* and 34*b* transferred through the timing belts 37*a* and 37*b*. The timing belts 37*a* and 37*b* are endless annular belts hung between the driving pulleys 35*a* and 35*b* and the driven pulleys 36*a* and 36*b*.

The timing belt 37*a* is connected to the cutting unit 33*a*. Therefore, the cutting unit 33*a* reciprocates in the width direction along the guide shafts 32*a* and 32*b* with the driving force of the moving motor 34*a* transferred through the timing belt 37*a*. The timing belt 37*b* is connected to the cutting unit 33*b*. Therefore, the cutting unit 33*b* reciprocates in the width direction along the guide shafts 32*a* and 32*b* with the driving force of the moving motor 34*b* transferred through the timing belt 37*b*.

That is, the moving motor 34*a*, the driving pulley 35*a*, the driven pulley 36*a*, and the timing belt 37*a* are examples of moving mechanism that move the cutting unit 33*a* in the width direction. The moving motor 34*b*, the driving pulley 35*b*, the driven pulley 36*b*, and the timing belt 37*b* are examples of moving mechanism that move the cutting unit 33*b* in the width direction. In this way, the moving mechanisms can move the cutting units 33*a* and 33*b* independently of each other.

Figure 6:
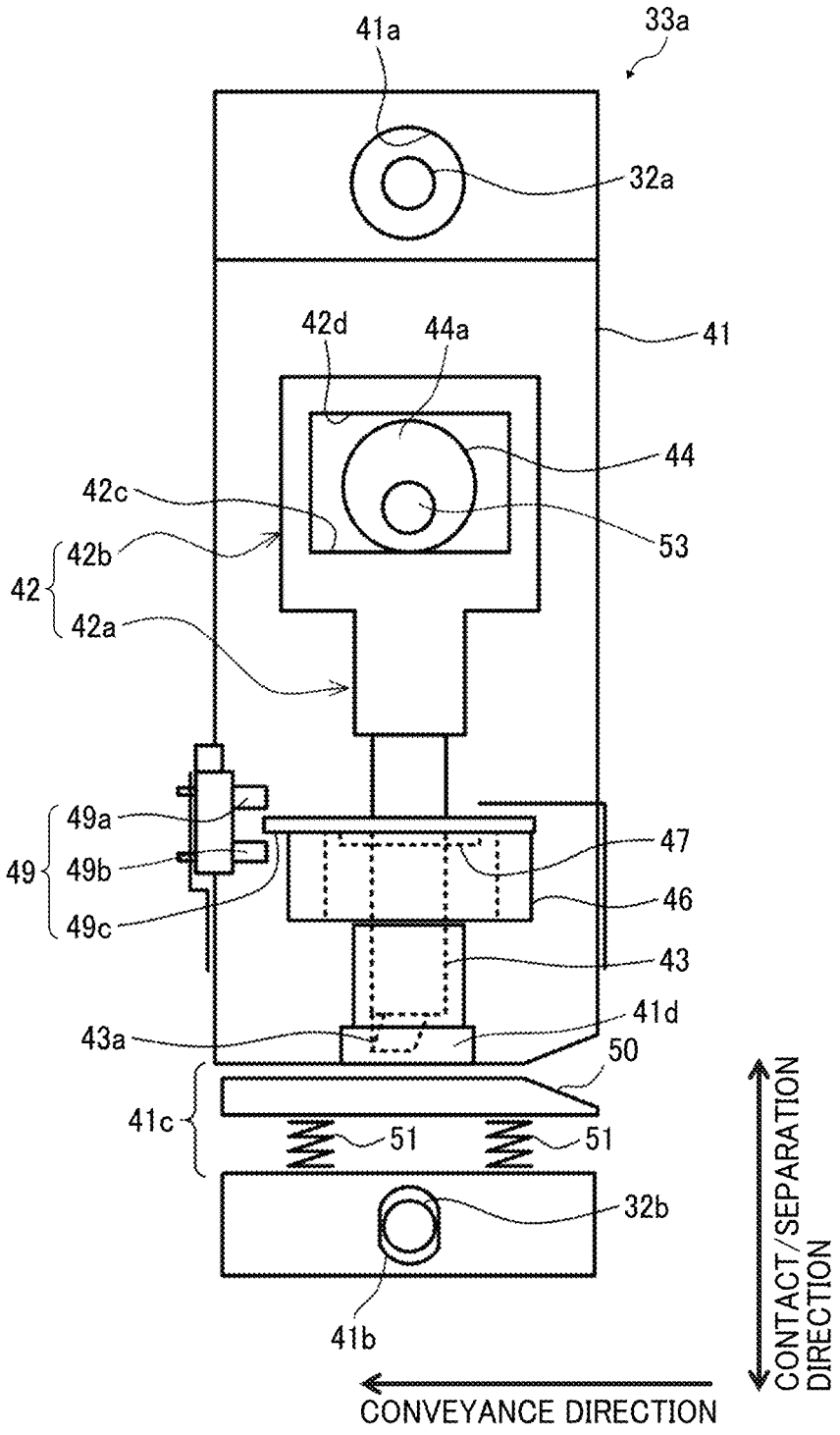
FIG. 6 is a view of the cutting unit as viewed from the width direction.
Figure 7:
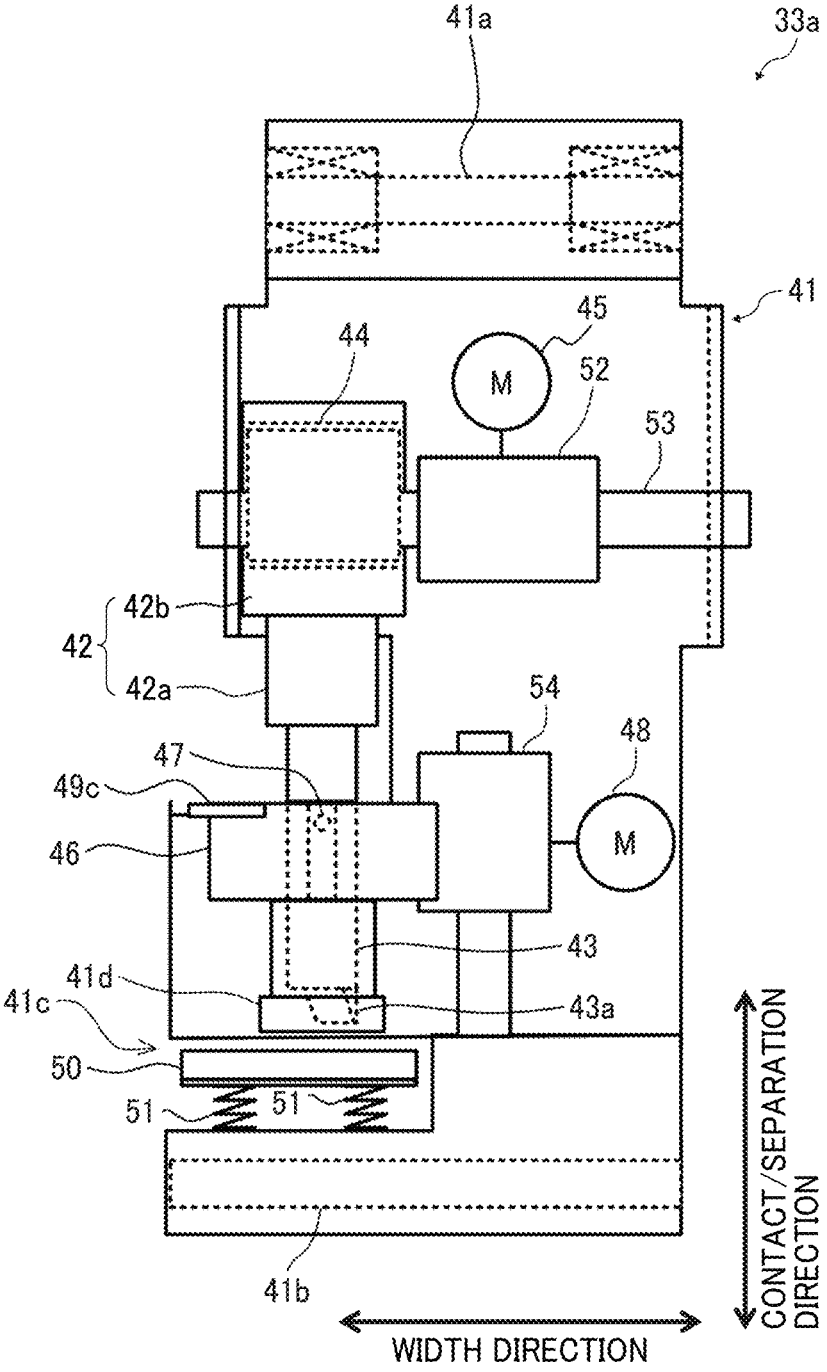
FIG. 7 is a view of the cutting unit as viewed from the conveyance direction.
Figure 8:
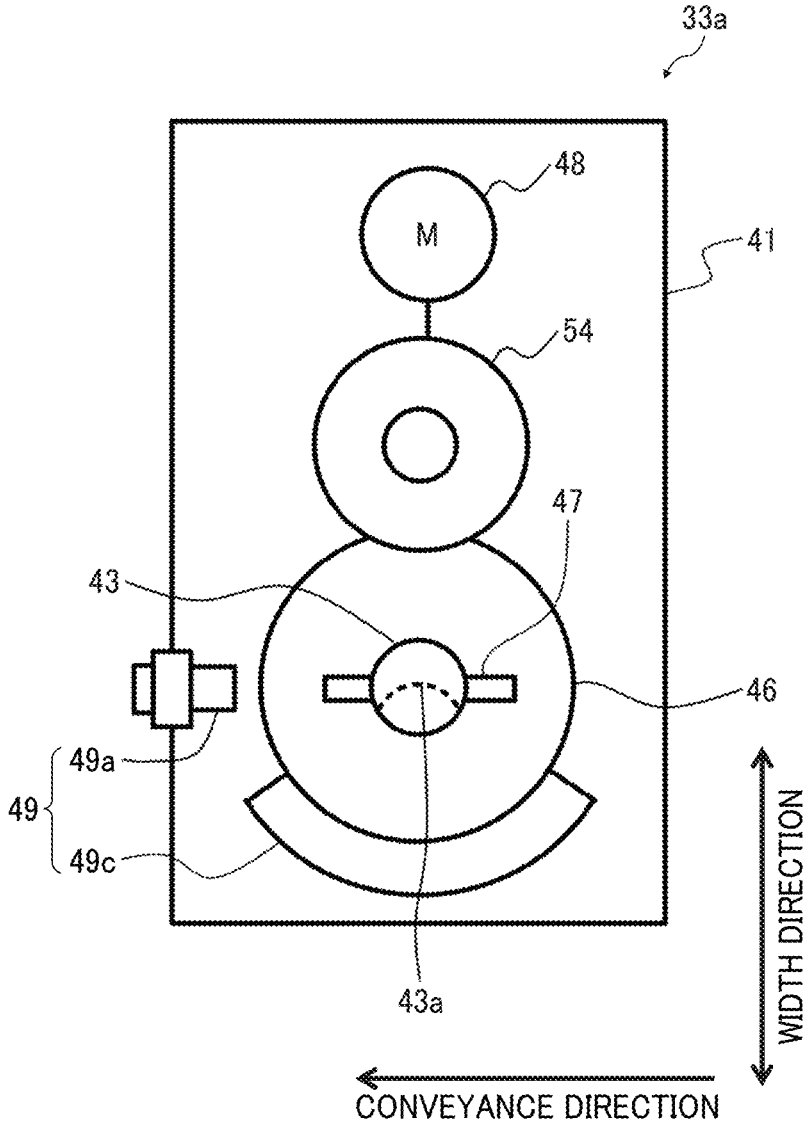
FIG. 8 is a plan view of the cutting unit.

FIG. 6 is a view of the cutting unit 33*a* as viewed from the width direction. FIG. 7 is a view of the cutting unit 33*a* as viewed from the conveyance direction. FIG. 8 is a plan view of the cutting unit 33*a*. Since the configurations of the cutting units 33*a* and 33*b* are common, only the cutting unit 33*a* will be described in detail below. As illustrated in FIGS. 6 to 8, the cutting unit 33*a* mainly includes a frame 41, a cam guide 42, a blade body 43, a cam 44, a contact-and-separation motor 45, a rotary gear 46, a pin 47, a switching motor 48, a rotation sensor 49, a receiving plate 50, and a coil spring 51.

The frame 41 constitutes the outer shell of the cutting unit 33*a*. The frame 41 is a housing including an internal space for accommodating the components 42 to 49 of the cutting unit 33*a*. The upper part of the frame 41 has a through hole 41*a* into which the guide shaft 32*a* is inserted via a linear bush. The lower part of the frame 41 has a through hole 41*b* into which the guide shaft 32*b* is inserted via a linear bush. The frame 41 has a recess 41*c* at a position corresponding to the conveyance path R. The frame 41 has a burring-processed through hole 41*d* on the top surface defining the recess 41*c*.

The cam guide 42 is housed in the internal space of the frame 41 so as to be movable in the vertical direction. The cam guide 42 has a holding portion 42*a* for holding the blade body 43 and a frame 42*b* for accommodating the cam 44.

The blade body 43 has a substantially cylindrical outer shape. An arc-shaped cutting blade 43*a* is formed at the tip of the blade body 43. The cutting blade 43*a* has a fan shape with a central angle of 90°. The blade body 43 is held by the holding portion 42*a* of the cam guide 42 with the cutting blade 43*a* facing downward. The blade body 43 is held by the holding portion 42*a* via a bearing so as to be rotatable around a rotation axis extending in the axial direction (that is, the vertical direction) of the cylinder. The cutting blade 43*a* of the blade body 43 held by the holding portion 42*a* faces the through hole 41*d* of the frame 41.

The cam 44 is housed in the frame 42*b* of the cam guide 42. The cam 44 rotates around a drive shaft 53 extending in the horizontal direction with the driving force of the contact-and-separation motor 45 transferred through the drive gear 52. A cam lobe (cam ridge) 44*a* is formed on a part of the outer peripheral surface of the cam 44 in the circumferential direction. Then, when the cam lobe 44*a* comes into contact with the bottom surface 42*c* of the frame 42*b*, the cam guide 42 moves downward. On the other hand, when the cam lobe 44*a* comes into contact with the top surface 42*d* of the frame 42*b*, the cam guide 42 moves upward. That is, when the contact-and-separation motor 45 is rotationally driven, the cam guide 42 moves up and down periodically according to the position of the cam lobe 44*a*.

The blade body 43 moves up and down together with the cam guide 42. Then, when the blade body 43 moves downward, the cutting blade 43*a* projects into the recess 41*c* through the through hole 41*d*. As a result, the cutting blade 43*a* comes into contact with the sheet M passing the recess 41*c* (that is, the conveyance path R). On the other hand, when the blade body 43 moves upward, the cutting blade 43*a* is sunk in the internal space of the frame 41 through the through hole 41*d*. As a result, the cutting blade 43*a* is separated from the sheet M passing the recess 41*c* (that is, the conveyance path R). The cam guide 42, the cam 44, the contact-and-separation motor 45, the drive gear 52, and the drive shaft 53 are an example of the contact-and-separation mechanism that brings the cutting blade 43*a* into contact with and away from the sheet M.

The rotary gear 46 has a ring-shaped outline. When the blade body 43 is inserted into the rotary gear 46, the rotary gear 46 is integrated with the blade body 43 by a pin 47. The rotary gear 46 rotates together with the blade body 43 around the rotation axis extending in the vertical direction, with the driving force of the switching motor 48 transferred through the drive gear 54. As a result, the posture of the cutting blade 43*a* (orientation of the arc) is switched. The rotary gear 46, the switching motor 48, and the drive gear 54 are an example of switching mechanism that switches the posture of the cutting blade 43*a*.

The rotation sensor 49 is an example of a rotation angle detector that detects the rotation angle of the blade body 43 (in other words, the cutting blade 43*a*). The rotation sensor 49 includes, for example, a light emitting unit 49*a*, a light receiving unit 49*b*, and a shielding plate 49*c*. The light emitting unit 49*a* and the light receiving unit 49*b* face each other in the vertical direction. The shielding plate 49*c* protrudes outward in the radial direction from a part of the outer peripheral surface of the rotary gear 46, and has a predetermined length in the circumferential direction. Then, as the rotary gear 46 rotates, the shielding plate 49*c* enters into between the light emitting unit 49*a* and the light receiving unit 49*b*, and exits from between the light emitting unit 49*a* and the light receiving unit 49*b*.

When the shielding plate 49*c* does not exist between the light emitting unit 49*a* and the light receiving unit 49*b*, the light output from the light emitting unit 49*a* is received by the light receiving unit 49*b*. At this time, the rotation sensor 49 outputs a detection signal to the controller 100. On the other hand, when the shielding plate 49*c* exists between the light emitting unit 49*a* and the light receiving unit 49*b*, the light output from the light emitting unit 49*a* is blocked by the shielding plate 49*c* and is not received by the light receiving unit 49*b*. At this time, the rotation sensor 49 does not output a detection signal to the controller 100.

The receiving plate 50 is supported on the bottom surface defining the recess 41*c* via a coil spring 51. The receiving plate 50 supports the sheet M passing the recess 41*c* from below. The cutting blade 43*a* protruding from the through hole 41*d* moves further downward even after contact with the sheet M. At this time, the coil spring 51 is elastically compressed, so that the receiving plate 50 is pressed downward. As a result, the cutting blade 43*a* is pressed against the sheet M. and the end portion of the sheet M is cut in an arc shape. On the other hand, when the cutting blade 43*a* is sunk in the internal space of the frame 41 through the through hole 41*d*, the coil spring 51 elastically returns and the receiving plate 50 returns to its original position.

Figure 9:
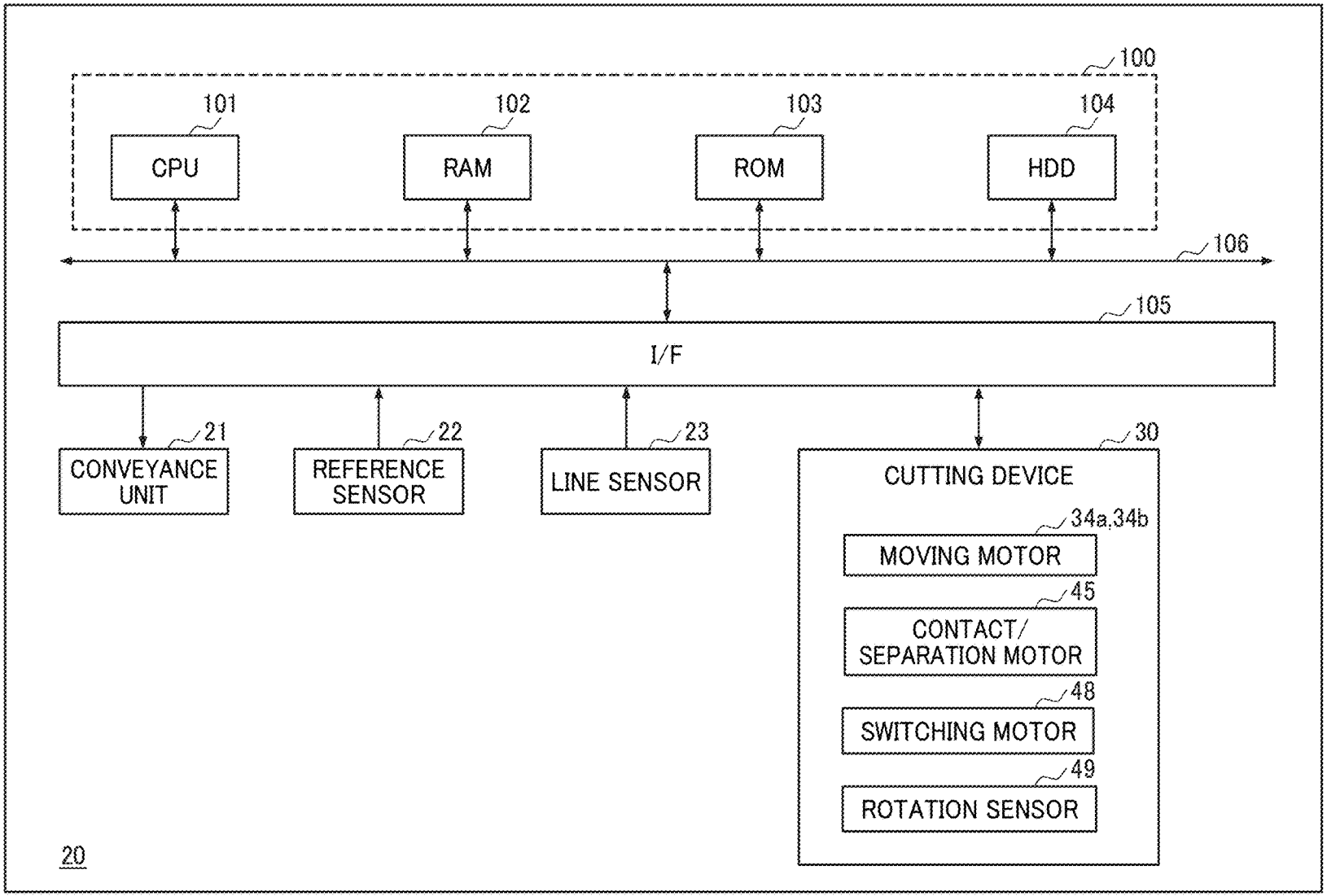
FIG. 9 is a diagram illustrating a hardware configuration of the post-processing apparatus.

FIG. 9 is a diagram illustrating a hardware configuration of the post-processing apparatus 20. The post-processing apparatus 20 includes a central processing unit (CPU) 101 as a control device or control circuitry, a random access memory (RAM) 102 as a storage device, a read only memory (ROM) 103 as a storage device, a hard disk drive (HDD) 104 as a storage device, and an interface (I/F) 105 as an interface, which are connected via a common bus 106 as a communication device. The CPU 101, the RAM 102, the ROM 103, and the HDD 104 are examples of the controller 100.

The CPU 101 is an arithmetic unit and controls the operations of the entire post-processing apparatus 20. The RAM 102 is a volatile storage medium capable of reading and writing information at high speed, and is used as a work area for the CPU 101 to process the information. The ROM 103 is a read-only non-volatile storage medium, and stores programs such as firmware. The HDD 104 is anon-volatile storage medium capable of reading and writing information and having a large storage capacity, and stores an operating system (OS), various control programs, application programs, and the like.

The post-processing apparatus 20 processes control programs stored in the ROM 103 and information processing programs (application programs) loaded into the RAM 102 from a storage medium such as the HDD 104 by an arithmetic function provided in the CPU 101. The processing constitutes software control units including various functional modules of the post-processing apparatus 20. The combination of the software control unit configured in this way and the hardware resources mounted on the post-processing apparatus 20 constitutes functional blocks that implement the functions of the post-processing apparatus 20.

The I/F 105 is an interface for connecting the conveyance unit 21, the reference sensor 22, the line sensor 23, and the cutting device 30 to the common bus 106. That is, the controller 100 controls the conveyance unit 21, the reference sensor 22, the line sensor 23, and the cutting device 30 through the I/F 105.

More particularly, the controller 100 determines the position of the sheet M on the conveyance path R by combining a detection signal from the reference sensor 22 and a pulse signal from a rotary encoder included in the motor of the conveyance unit 21. That is, the combination of the reference sensor 22 and the rotary encoder in the motor of the conveyance unit 21 is an example of sheet position detector that detects the position of the sheet M conveyed by the conveyance unit 21.

The controller 100 also determines the posture of the cutting blade 43*a* (that is, the rotation angle of the cutting blade 43*a*) by the combination of a detection signal from the rotation sensor 49 and a pulse signal from a rotary encoder included in the switching motor 48. That is, the combination of the rotation sensor 49 and the rotary encoder of the switching motor 48 is an example of rotation angle detector that detects the rotation angle of the cutting blade 43*a*.

The controller 100 also determines the positions of the cutting units 33*a* and 33*b* in the width direction by pulse signals from the rotary encoders mounted on the moving motors 34*a* and 34*b*. The controller 100 further determines the position of the cutting blade 43*a* in the vertical direction by a pulse signal from a rotary encoder included in the contact-and-separation motor 45.

Figure 10:
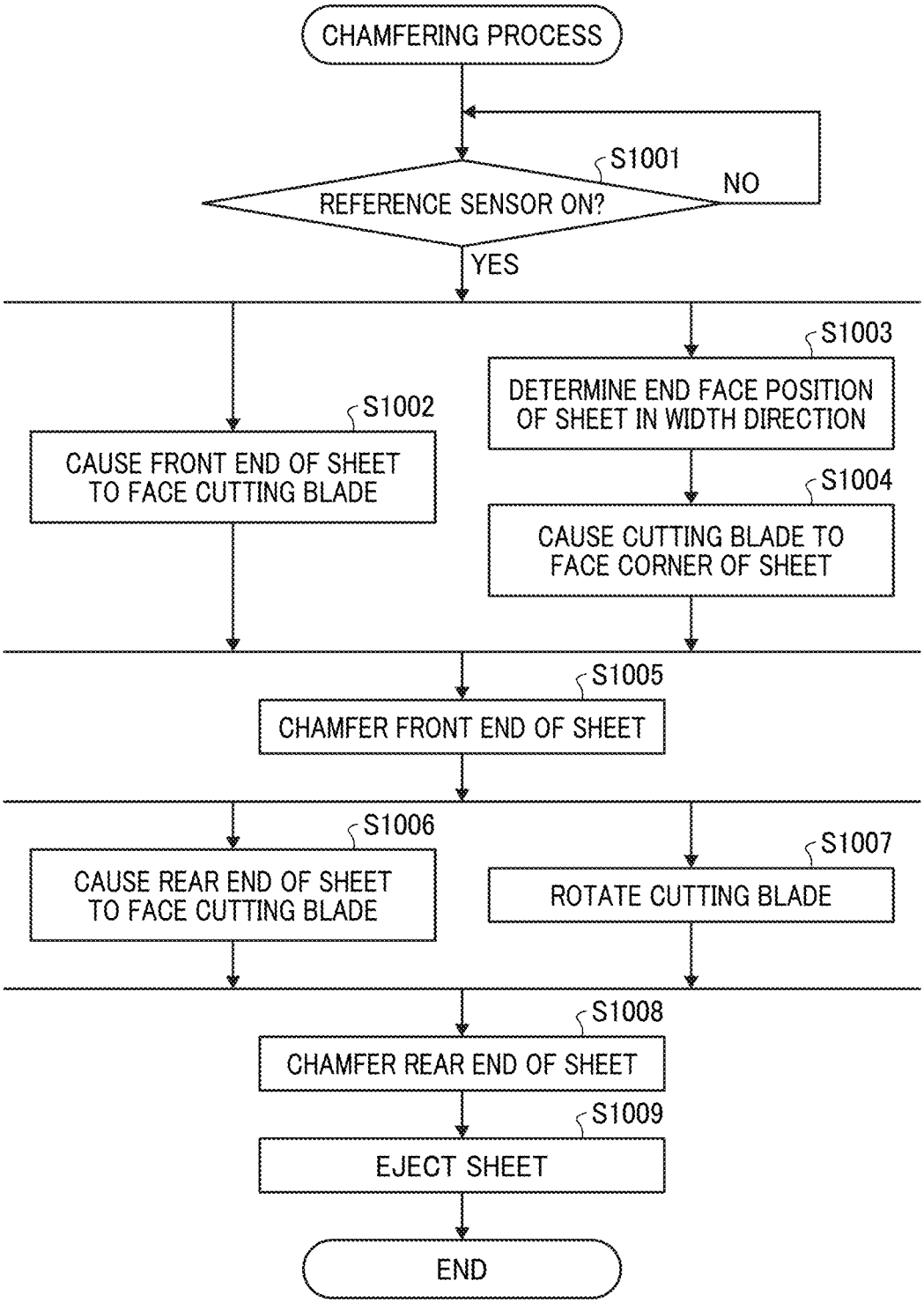
FIG. 10 is a flowchart of a chamfering process.

Next, the chamfering process will be described with reference to FIGS. 10 to 12E. FIG. 10 is a flowchart of the chamfering process. FIGS. 11A to 11F are diagrams illustrating a positional relationship between the sheet M and the cutting units 33*a* and 33*b* in each phase of the first half of the chamfering process. FIGS. 12A to 12E are diagrams illustrating a positional relationship between the sheet M and the cutting units 33*a* and 33*b* in each phase of the second half of the chamfering process. The controller 100 executes the chamfering process illustrated in FIG. 10 on each of the sheets M supplied from the image forming apparatus 10.

Based on the results of detection by the reference sensor 22 and the rotary encoder in the motor of the conveyance unit 21, the controller 100 conveys the sheet M by the conveyance unit 21 so that the cutting position of the sheet M faces the cutting blade 43*a*. Based on the results of detection by the rotation sensor 49, the controller 100 switches the posture of the cutting blade 43*a* by the switching mechanism so that the posture corresponds to the cutting position. The controller 100 brings the cutting blade 43*a* in the posture corresponding to the cutting position into contact with and away from the sheet M by the contact-and-separation mechanism. Hereinafter, each step of the chamfering process will be described in detail with reference to FIGS. 10 to 12E.

By driving the motor of the conveyance unit 21, the controller 100 rotates the roller pairs 21*a* to 21*e* in the direction of conveying the sheet M in the conveyance direction. Then, the controller 100 waits until the reference sensor 22 starts outputting the detection signal (that is, the reference sensor 22 turns on) (S1001: No). Then, when the sheet M reaches the position illustrated in FIG. 11B through the position illustrated in FIG. 11A, the reference sensor 22 turns from OFF to ON.

Next, at the timing when the reference sensor 22 turns on (S1001: Yes), the controller 100 starts counting the number of pulse signals output from the rotary encoder in the motor of the conveyance unit 21. Then, at the timing when the number of counted pulse signals reaches a threshold pulse number, the controller 100 stops the conveyance of the sheet M by the conveyance unit 21 (S1002). The threshold pulse number is a predetermined number corresponding to the distance from the installation position of the reference sensor 22 to the position facing the cutting blade 43*a*. Accordingly, as illustrated in FIG. 11D, the sheet M is conveyed to a position where the front end of the sheet M faces the cutting blade 43*a*. At this time, the sheet M is sandwiched by the roller pair 21*b*.

Figure 11C:
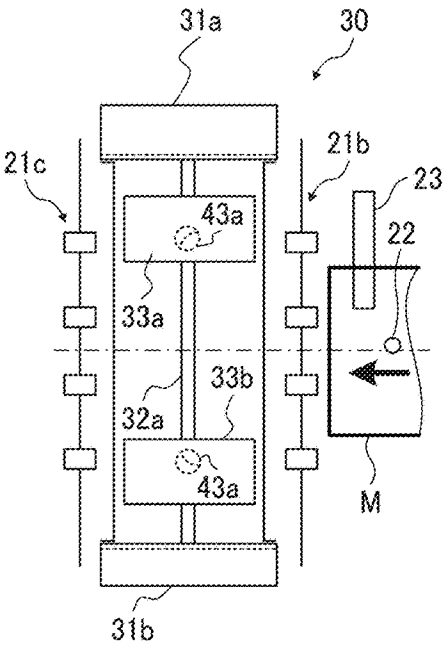
FIGS. 11A to 11F are diagrams illustrating a positional relationship between a sheet M and the cutting units in each phase of the first half of the chamfering process.
Figure 11B:
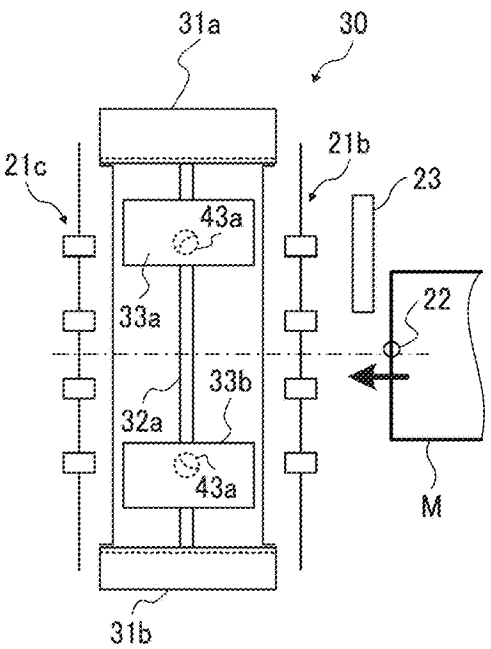
Figure 11A:
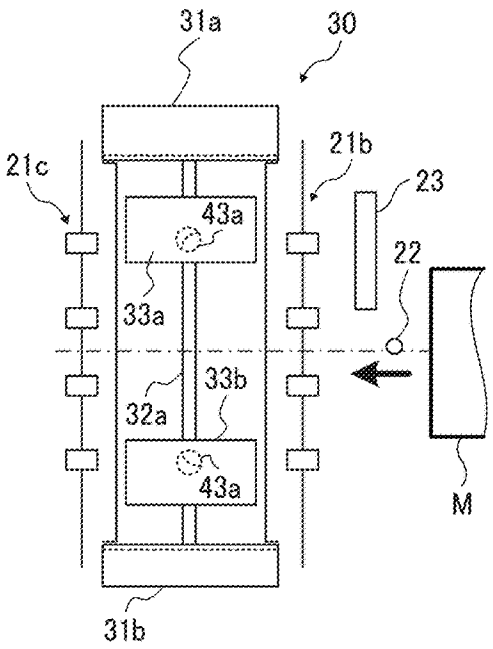

Further, as illustrated in FIG. 11C, when the sheet M faces the line sensor 23, the controller 100 determines the end face position (right end position) of the sheet M in the width direction based on the detection signal output from the line sensor 23 (S1003). Then, as illustrated in FIG. 11E, the controller 100 drives the moving motors 34*a* and 34*b* based on the determined end face position in the width direction to cause the cutting blade 43*a* of the cutting unit 33*a* to face the right end of the sheet M, and cause the cutting blade 43*a* of the cutting unit 33*b* to face the left end of the sheet M (S1004). It is assumed that the left end position of the sheet M and the right end position of the sheet M are symmetrical with respect to the center of the conveyance path R.

Step S1003 is executed in the process of executing step S1002. On the other hand, step S1004 may be executed in the process of executing step S1002, or may be executed after step S1002 is completed. That is, the controller 100 may execute steps S1002 and S1004 in parallel or in order.

As illustrated in FIGS. 11A to 11D, the cutting blade 43*a* (first cutting blade) of the cutting unit 33*a* is set in advance in a first posture in which to chamfer the right corner of the front end (hereinafter, referred to as "front right corner") of the sheet M. The first posture is a posture in which the cutting blade 43*a* is located inside the front right corner of the sheet M and becomes convex toward the front right corner. More particularly, the first posture is a posture in which one end of the arc-shaped cutting blade 43*a* connects to the side of the front end of the sheet M and the other end connects to the side of the right end of the sheet M.

As illustrated in FIGS. 11A to 11D, the cutting blade 43*a* (second cutting blade) of the cutting unit 33*b* is set in advance in a third posture in which to chamfer the left corner of the front end (hereinafter, referred to as "front left corner") of the sheet M. The third posture is a posture in which the cutting blade 43*a* is located inside the front left corner of the sheet M and becomes convex toward the front left corner. More particularly, the third posture is a posture in which one end of the arc-shaped cutting blade 43*a* connects to the side of the front end of the sheet M and the other end connects to the side of the left end of the sheet M.

Figure 11F:
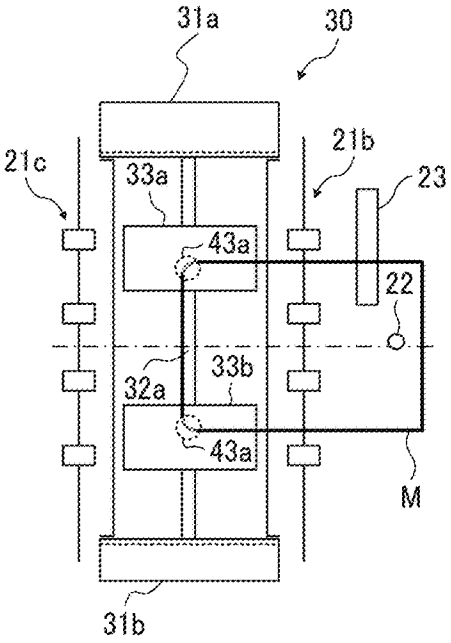
Figure 11E:
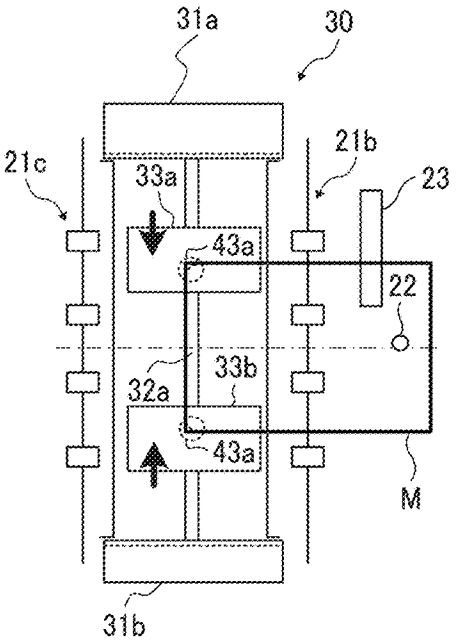
Figure 11D:
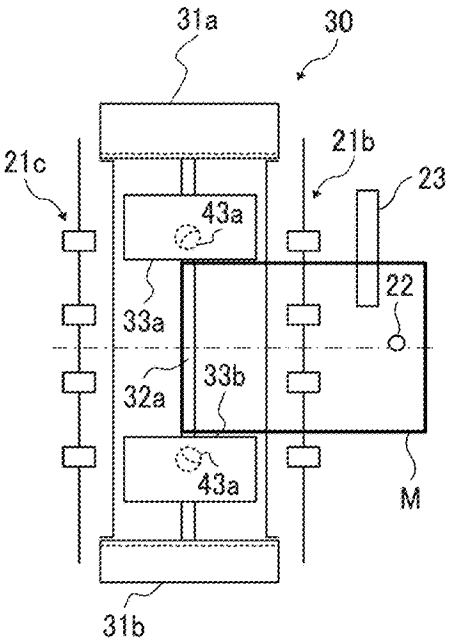

When both steps S1002 and S1004 are completed, as illustrated in FIG. 11F, the cutting blade 43*a* of the cutting unit 33*a* faces the front right corner of the sheet M, and the cutting blade 43*a* of the cutting unit 33*b* faces the front left corner of the sheet M. Therefore, the controller 100 drives the contact-and-separation motor 45 until the cam 44 makes one rotation (S1005). As a result, the respective cutting blades 43*a* of the cutting units 33*a* and 33*b* come into contact with the sheet M and separate again from the sheet M, thereby chamfering the front right corner and the front left corner of the sheet M.

Next, the controller 100 causes the conveyance unit 21 to restart the conveyance of the sheet M. As illustrated in FIG. 12A, when the rear end of the sheet M passes the position of the reference sensor 22, the reference sensor 22 turns from ON to OFF. At the timing when the reference sensor 22 turns from ON to OFF, the controller 100 starts counting the number of pulse signals output from the rotary encoder in the motor of the conveyance unit 21. At the timing when the number of counted pulse signals reaches a threshold pulse number, the controller 100 stops the conveyance of the sheet M by the conveyance unit 21 (S1006).

Figure 12C:
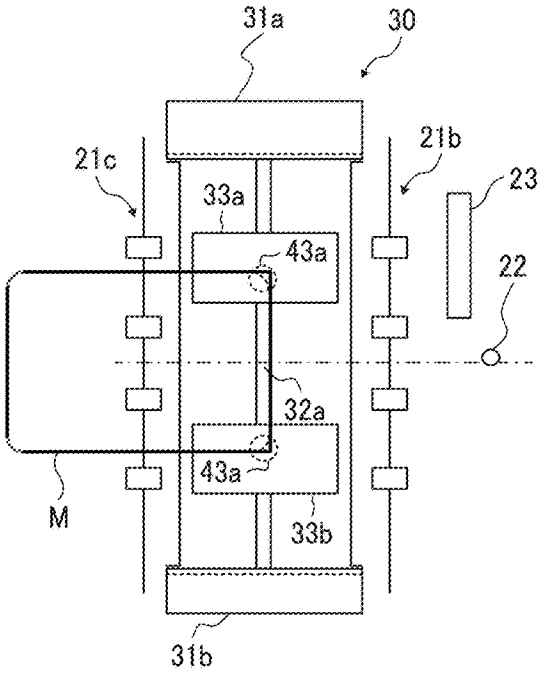
FIGS. 12A to 12E are diagrams illustrating a positional relationship between the sheet M and the cutting units in each phase of the second half of the chamfering process.

Accordingly, as illustrated in FIG. 12C, the sheet M is conveyed to a position where the rear end of the sheet M faces the cutting blade 43*a*. At this time, the sheet M is sandwiched by the roller pair 21*c*. More particularly, the cutting blade 43*a* of the cutting unit 33*a* faces the right corner of the rear end (hereinafter, referred to as "rear right corner") of the sheet M, and the cutting blade 43*a* of the cutting unit 33*b* faces the left corner of the rear end (hereinafter, referred to as "rear left corner") of the sheet M.

Figure 12B:
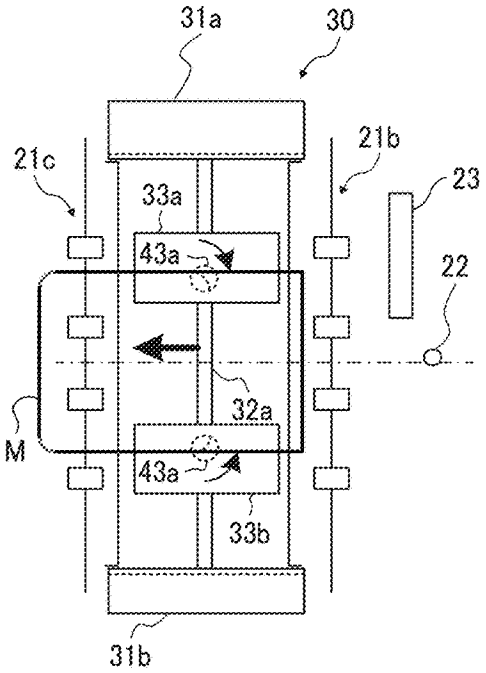
Figure 12A:
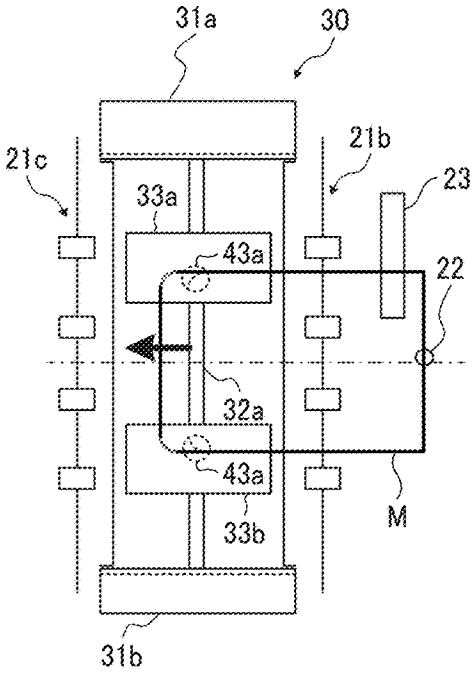

Further, as illustrated in FIG. 12B, the controller 100 rotates the cutting blades 43*a* by driving the respective switching motors 48 of the cutting units 33*a* and 33*b* (S1007). More particularly, the controller 100 brings the cutting blade 43*a* of the cutting unit 33*a* into the second posture in which to chamfer the rear right corner of the sheet M, and brings the cutting blade 43*a* of the cutting unit 33*b* into a fourth posture in which to chamfer the rear left corner of the sheet M.

The second posture is a posture in which the cutting blade 43*a* is located inside the rear right corner of the sheet M and becomes convex toward the rear right corner. More specifically, the second posture is a posture in which one end of the arc-shaped cutting blade 43*a* connects to the side of the rear end of the sheet M and the other end connects to the side of the right end of the sheet M. That is, the controller 100 switches from the first posture to the second posture by rotating the cutting blade 43*a* of the cutting unit 33*a* clockwise by 90°.

The fourth posture is a posture in which the cutting blade 43*a* is located inside the rear left corner of the sheet M and becomes convex toward the rear left corner. More specifically, the fourth posture is a posture in which one end of the arc-shaped cutting blade 43*a* connects to the side of the rear end of the sheet M and the other end connects to the side of the left end of the sheet M. That is, the controller 100 switches from the third posture to the fourth posture by rotating the cutting blade 43*a* of the cutting unit 33*b* counterclockwise by 90°.

Step S1007 may be executed in the process of executing step S1006, or may be executed after step S1006 is completed. That is, the controller 100 may execute steps S1006 and S1007 in parallel or in order.

Figure 12E:
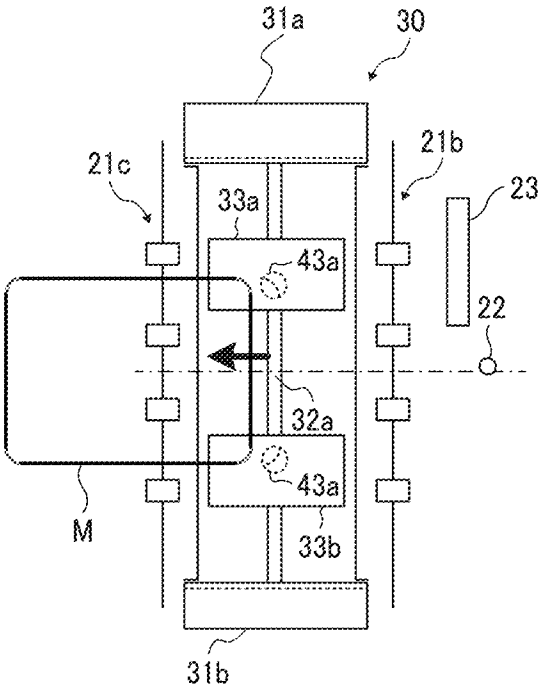
Figure 12D:
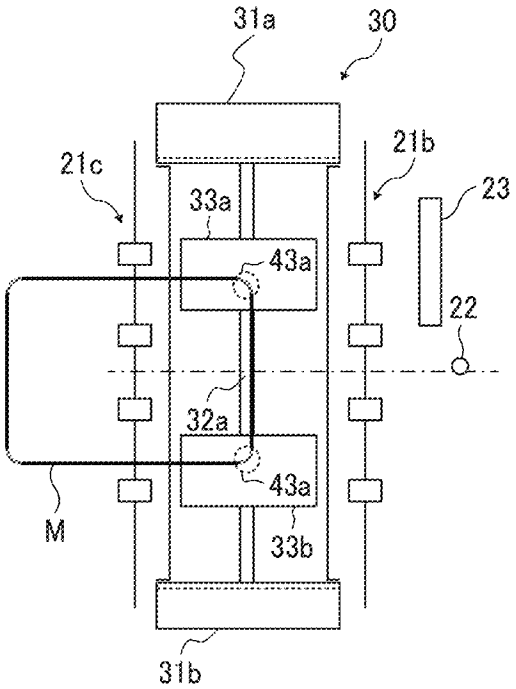

Next, when both steps S1006 and S1007 are completed, the controller 100 drives the contact-and-separation motor 45 until the cam 44 makes one rotation, as illustrated in FIG. 12D (S1008). As a result, the respective cutting blades 43*a* of the cutting units 33*a* and 33*b* come into contact with the sheet M and separate again from the sheet M, thereby chamfering the rear right corner and the rear left corner of the sheet M.

Next, as illustrated in FIG. 12E, the controller 100 ejects the sheet M to the paper ejection tray 25 by causing the conveyance unit 21 to restart the conveyance of the sheet M (S1009). Then, the controller 100 ends the chamfering process at the timing when the sheet M is ejected to the paper ejection tray 25.

According to the first embodiment, the following operational effects, for example, are achieved.

According to the first embodiment, the sheets M of various sizes can be chamfered by moving the cutting units 33*a* and 33*b* in the width direction. By rotating the cutting blade 43*a*, the cutting unit 33*a* can chamfer the front right corner and the rear right corner of the sheet M, and the cutting unit 33*b* can chamfer the front left corner and the rear left corner of the sheet M. As a result, any end of the sheet M can be chamfered with the simple configuration.

Second Embodiment

Figure 13A:
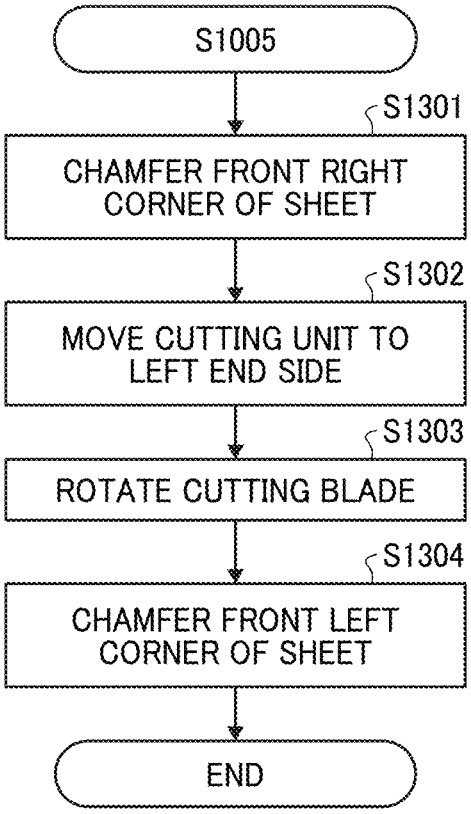
FIGS. 13A and 13B are flowcharts illustrating steps S1005 and S1008 according to a second embodiment of the chamfering process illustrated in FIG. 10.
Figure 13B:
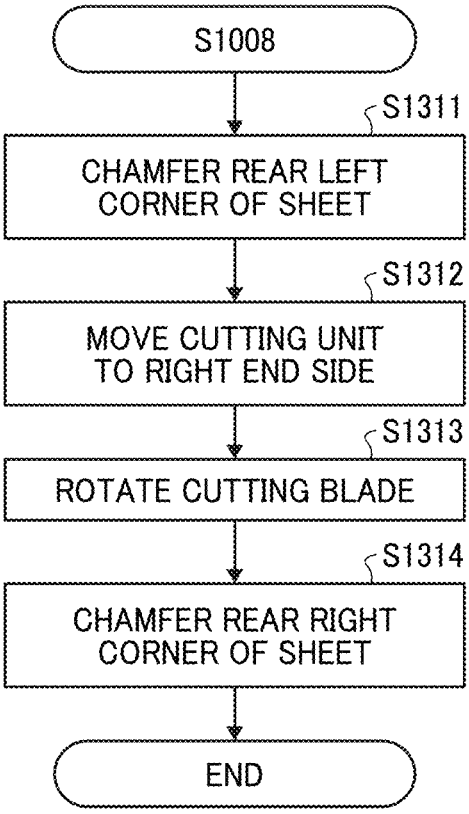

Next, a chamfering process according to a second embodiment will be described with reference to FIGS. 13A to 14F. FIGS. 13A and 13B are flowcharts illustrating steps S1005 and S1008 according to a second embodiment of the chamfering process illustrated in FIG. 10. FIGS. 14A to 14F are diagrams illustrating a positional relationship between a sheet M and a cutting unit 33*a* in each phase of the chamfering process according to the second embodiment. The detailed description of points in common with the first embodiment will be omitted, and the differences will be mainly described.

A cutting device 30A according to the second embodiment is different from the first embodiment in that a cutting unit 33*b* is omitted, and is the same as the first embodiment in other respects. In the chamfering process according to the second embodiment, steps S1005 and S1008 are different from the first embodiment, and other steps S1001 to S1004, S1006 and S1007, and S1009 are in common with the first embodiment.

In step S1005 of FIG. 10, a controller 100 according to the second embodiment executes steps S1301 to S1304 illustrated in FIG. 13A. At the timing when steps S1001 to S1004 in FIG. 10 are completed, a cutting blade 43*a* of the cutting unit 33*a* faces the front right corner of the sheet M and is in the first posture.

Figure 14C:
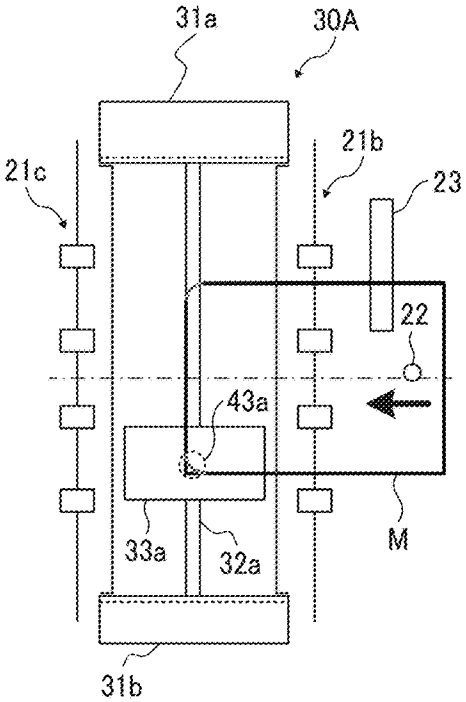
FIGS. 14A to 14F are diagrams illustrating a positional relationship between a sheet M and cutting units in each phase of a chamfering process according to the second embodiment.
Figure 14B:
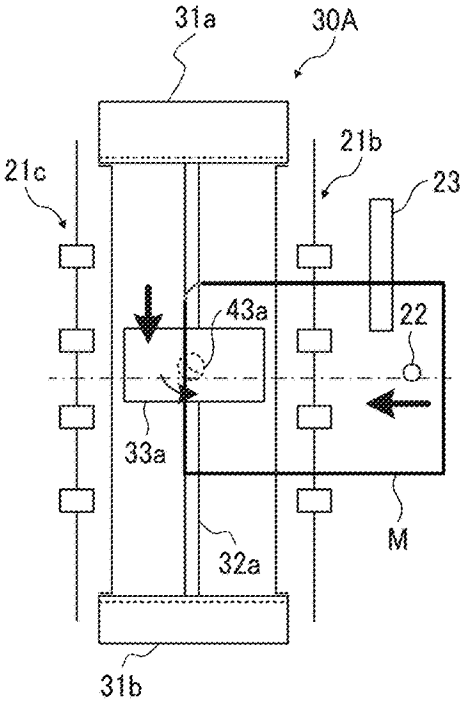
Figure 14A:
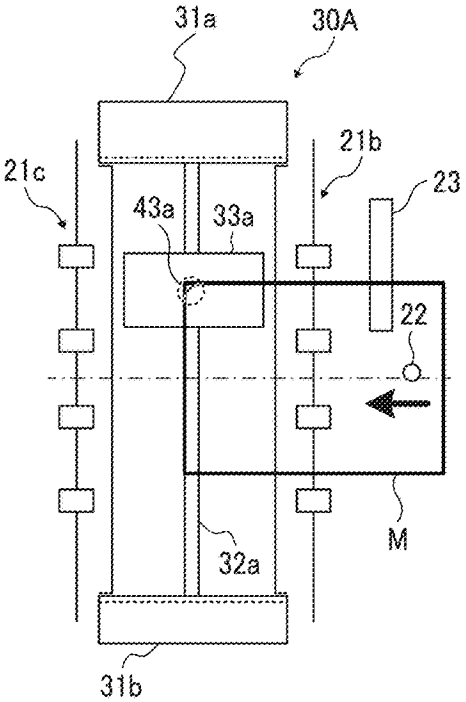

First, as illustrated in FIG. 14A, the controller 100 chamfers the front right corner of the sheet M with the cutting blade 43*a* by driving a contact-and-separation motor 45 (S1301). Next, as illustrated in FIG. 14B, the controller 100 moves the cutting unit 33*a* toward the left end side by driving the moving motor 34*a* (S1302). Further, the controller 100 switches the cutting blade 43*a* from the first posture to the third posture by driving a switching motor 48 (S1303). Next, as illustrated in FIG. 14C, the controller 100 chamfers the front left corner of the sheet M with the cutting blade 43*a* by driving the contact-and-separation motor 45 (S1304).

Further, in step S1008 of FIG. 10, the controller 100 according to the second embodiment executes steps S1311 to S1314 illustrated in FIG. 13B. At the timing when steps S1006 to S1007 in FIG. 10 are completed, the cutting blade 43*a* of the cutting unit 33*a* faces the rear left corner of the sheet M and is in the fourth posture.

Figure 14F:
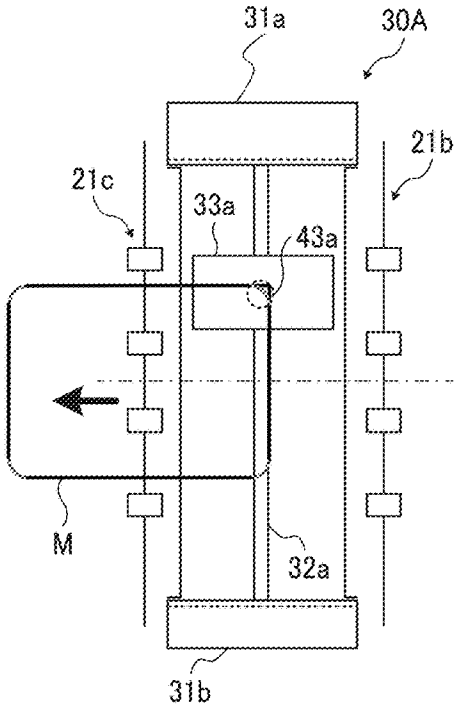
Figure 14E:
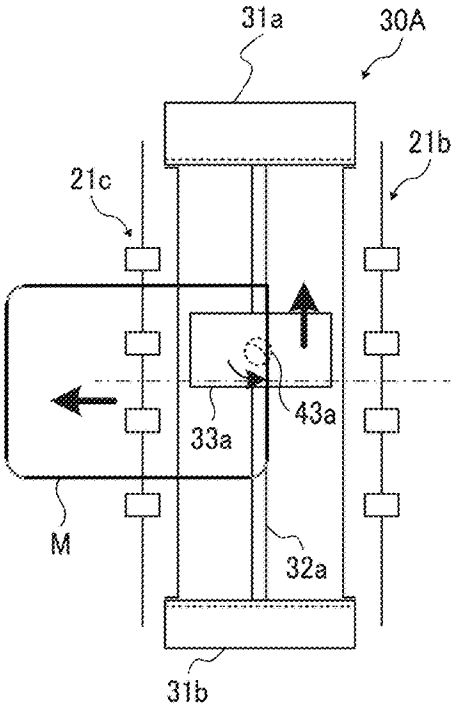
Figure 14D:
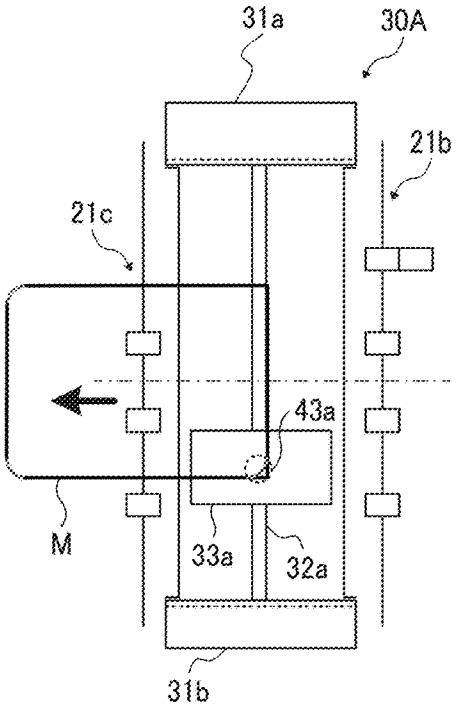

First, as illustrated in FIG. 14D, the controller 100 chamfers the rear left corner of the sheet M with the cutting blade 43*a* by driving the contact-and-separation motor 45 (S1311). Next, as illustrated in FIG. 14E, the controller 100 moves the cutting unit 33*a* toward the right end side by driving the moving motor 34*a* (S1312). Further, the controller 100 switches the cutting blade 43*a* from the fourth posture to the second posture by driving the switching motor 48 (S1313). Next, as illustrated in FIG. 14F, the controller 100 chamfers the rear right corner of the sheet M with the cutting blade 43*a* by driving the contact-and-separation motor 45 (S1314).

According to the second embodiment, by rotating the cutting blade 43*a* counterclockwise by 90°, the front right corner, front left corner, rear left corner, and rear right corner of the sheet M can be chamfered in this order with one cutting blade 43*a*. That is, the four corners of the sheet M can be chamfered with the structure further simpler than that of the first embodiment. The controller 100 may execute steps S1302 and S1303 in parallel or in order. Similarly, the controller 100 may execute steps S1312 and S1313 in parallel or in order.

Third Embodiment

Figure 15:
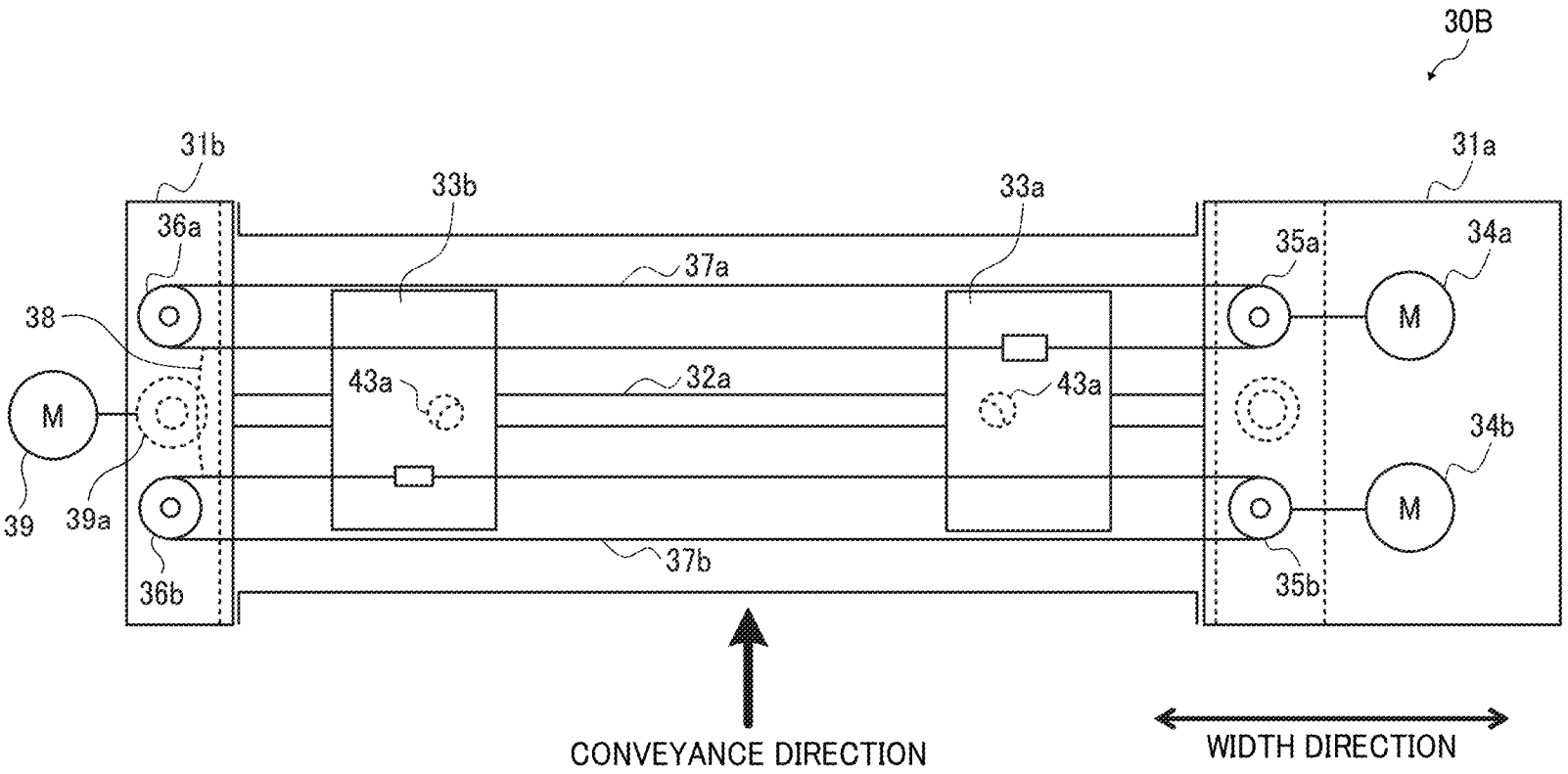
FIG. 15 is a plan view of a cutting device according to a third embodiment.
Figure 16:
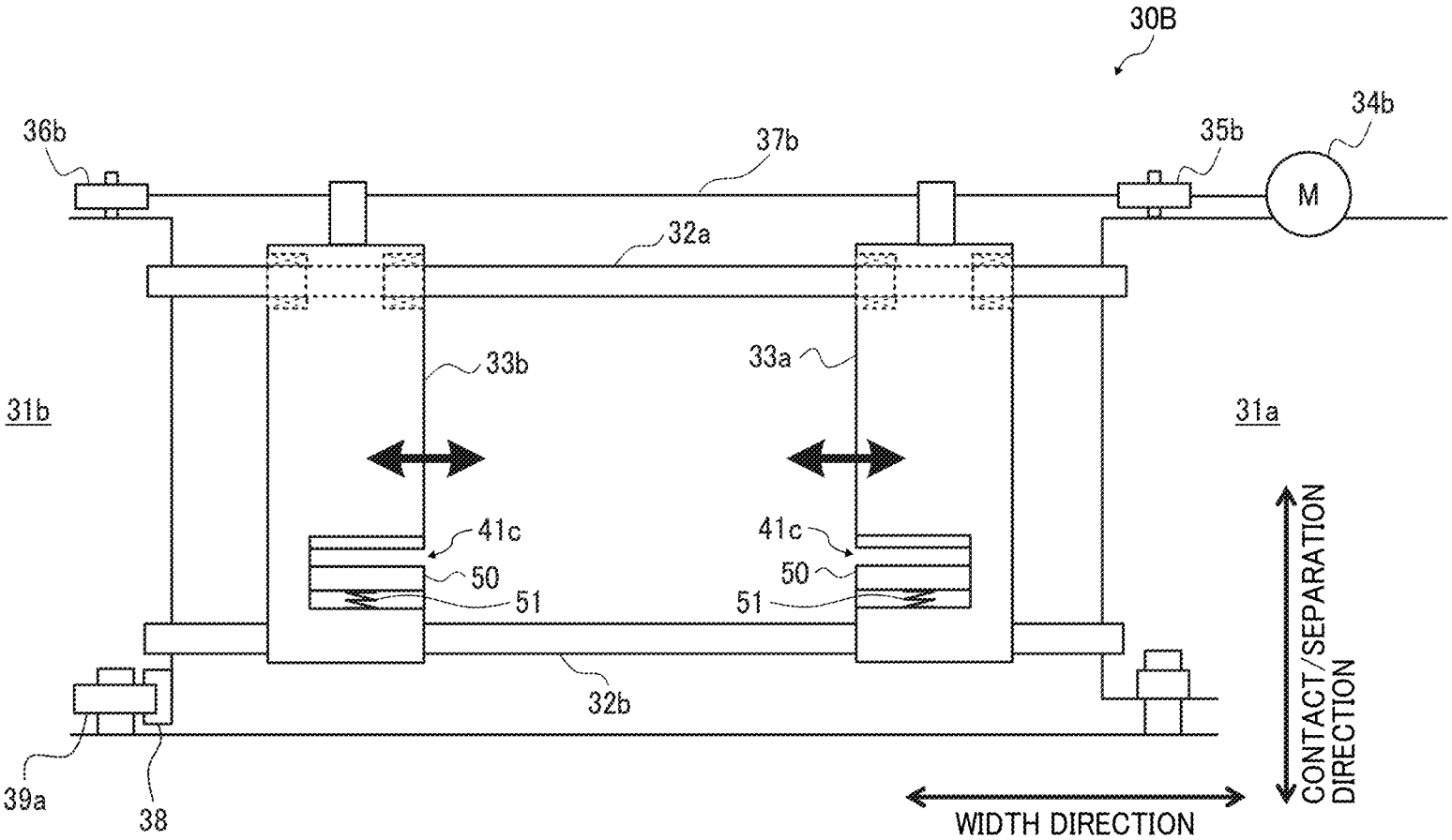
FIG. 16 is a view of the cutting device according to the third embodiment as viewed from the conveyance direction.
Figure 17:
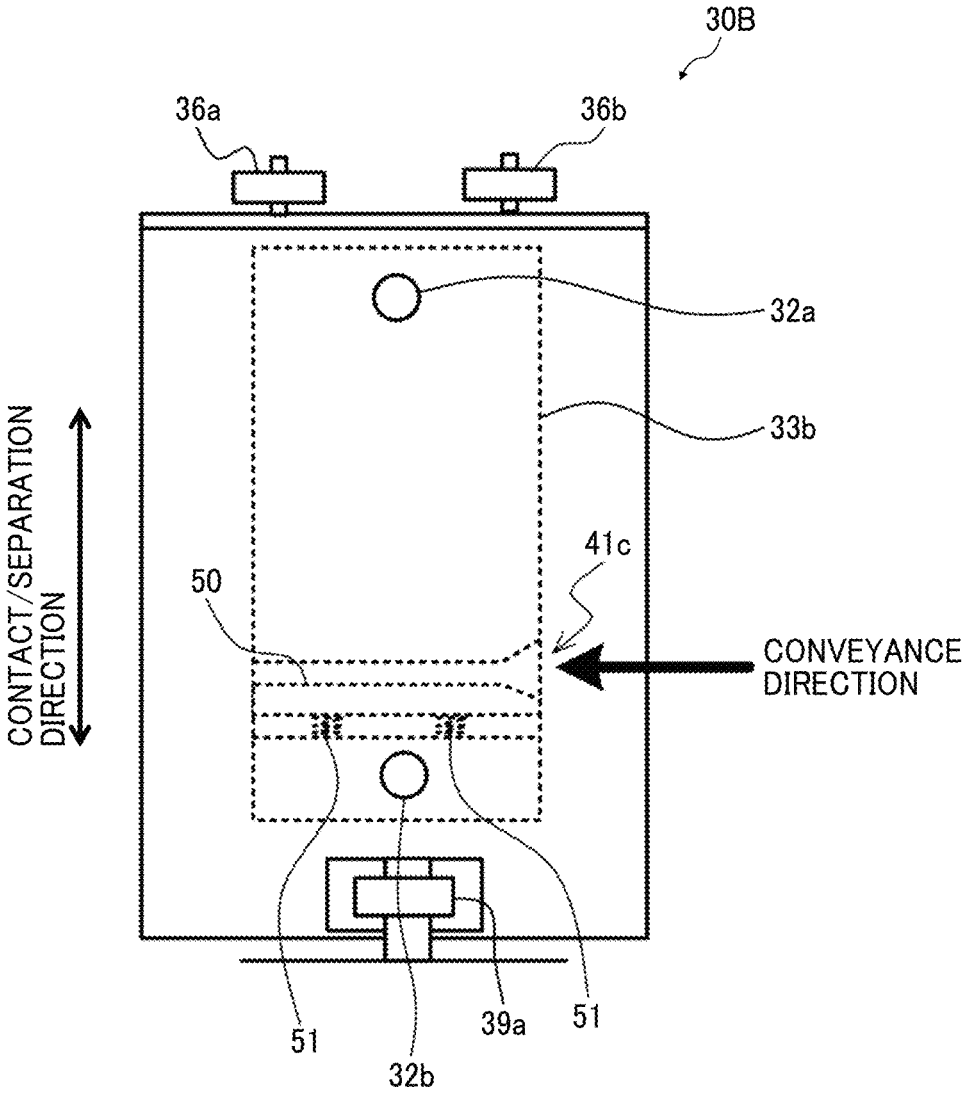
FIG. 17 is a view of the cutting device according to the third embodiment as viewed from the width direction.

Next, a cutting device 30B according to a third embodiment will be described with reference to FIGS. 15 to 19F. FIG. 15 is a plan view of the cutting device 30B according to the third embodiment. FIG. 16 is a view of the cutting device 30B according to the third embodiment as viewed from the conveyance direction. FIG. 17 is a view of the cutting device 30B according to the third embodiment as viewed from the width direction. The detailed description of points in common with the first embodiment will be omitted, and the differences will be mainly described. The cutting device 30B according to the third embodiment is different from the first embodiment in further including a rotating mechanism, and is the same as the first embodiment in other respects.

The cutting device 30B according to the third embodiment further includes a rotary gear 38 and a rotary motor 39. In addition, guide shafts 32*a* and 32*b* according to the third embodiment are supported by a side plate 31*a* via a bearing so as to be rotatable around a rotation axis extending in the vertical direction. The rotary gear 38 is attached to the other ends of the guide shafts 32*a* and 32*b*. The driving force of the rotary motor 39 is transmitted to the rotary gear 38 through the drive gear 39*a*.

Figure 19C:
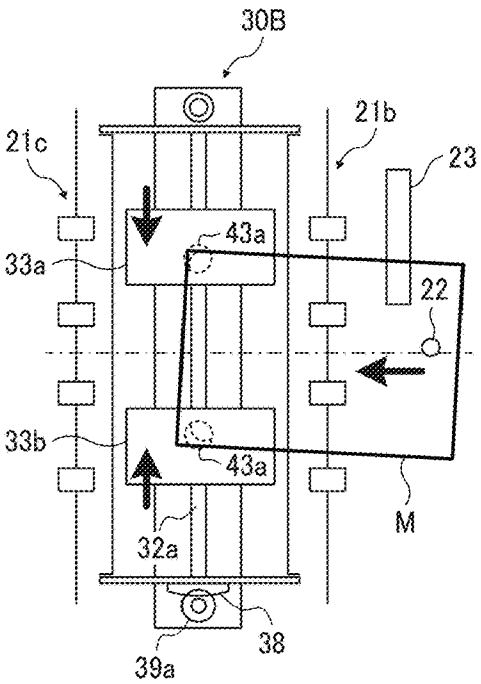
FIGS. 19A to 19F are diagrams illustrating a positional relationship between a sheet M and cutting units in each phase of a chamfering process according to the third embodiment.
Figure 19B:
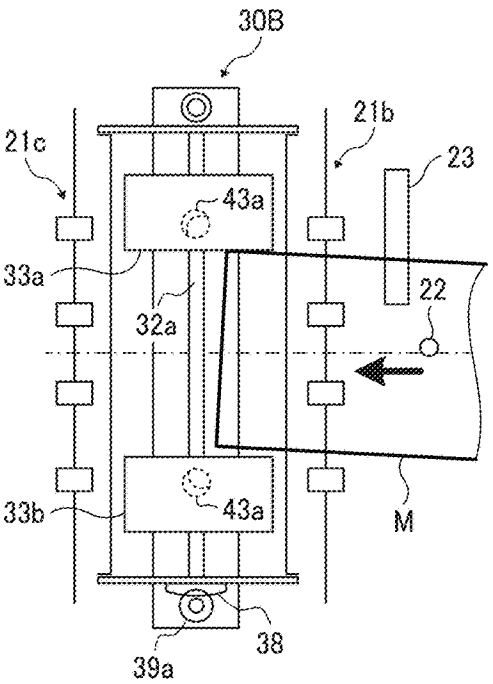
Figure 19A:
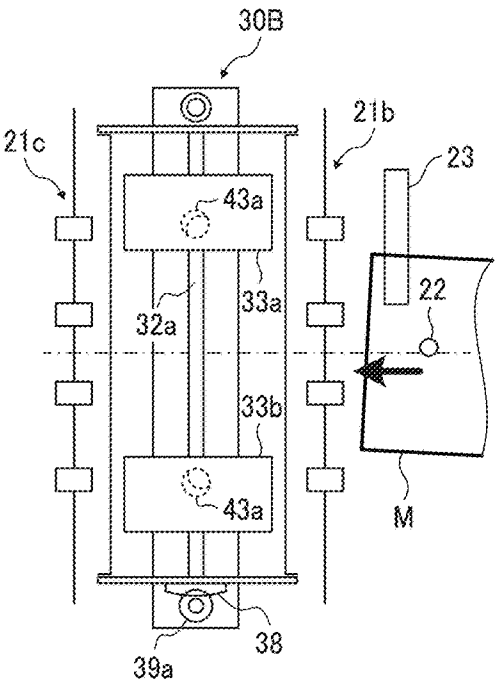
Figure 19F:
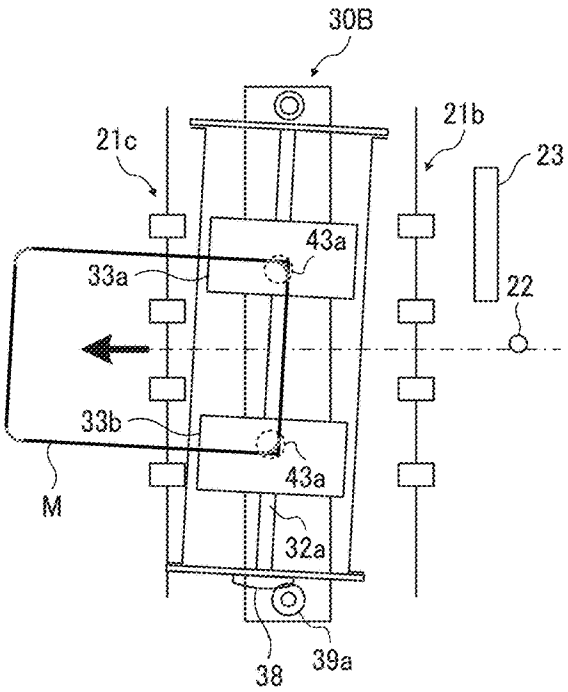
Figure 19E:
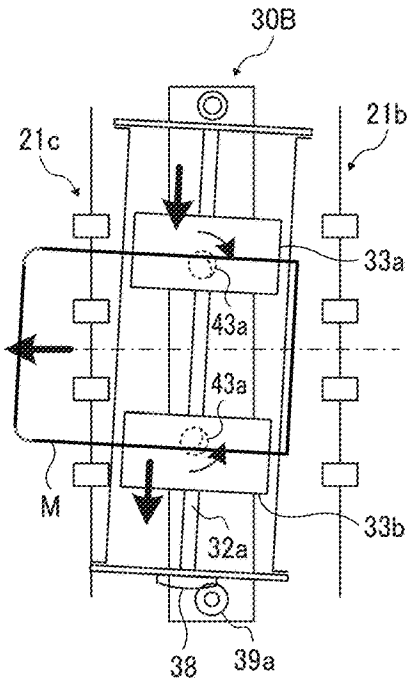
Figure 19D:
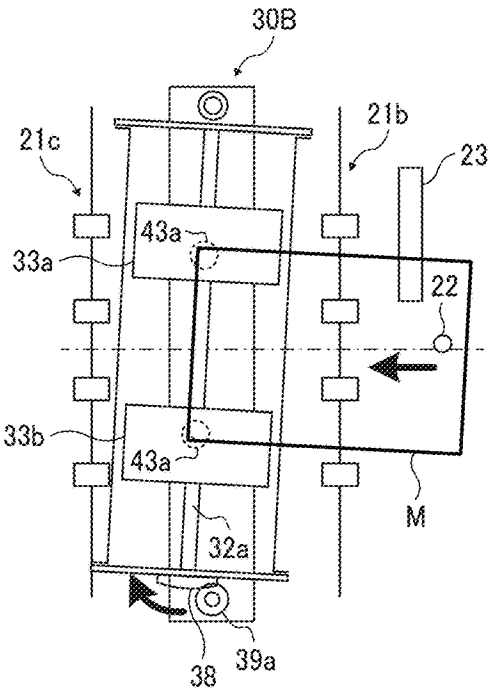

As a result, as illustrated in FIG. 19D, the guide shafts 32*a* and 32*b* each rotate on a plane parallel to the surface of the sheet M, with one end (the end near the side plate 31*a*) as the rotation center and the other end (the end near the side plate 31*b*) as the rotation tip. Then, the cutting units 33*a* and 33*b* are tilted as the guide shafts 32*a* and 32*b* rotate. The rotary gear 38, the rotary motor 39, and the drive gear 39*a* are examples of rotating mechanism that rotate the guide shafts 32*a* and 32*b* on first ends of the guide shafts 32*a* and 32*b* on a plane parallel to the surface of the sheet M.

Figure 18A:
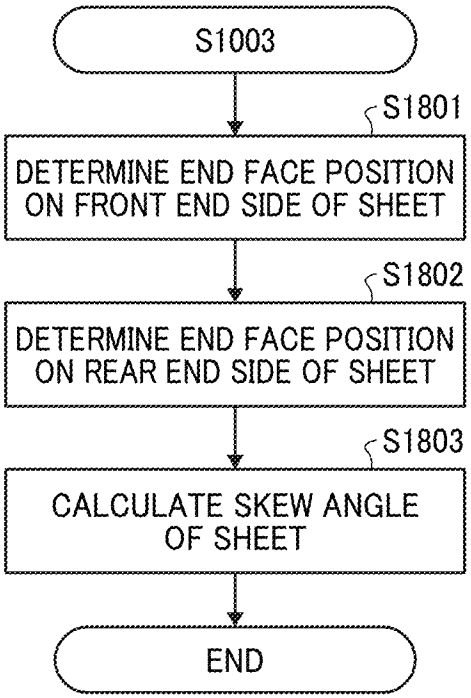
FIGS. 18A to 18C are flowcharts illustrating steps S1003, S1004, and S1007 according to the third embodiment of the chamfering process illustrated in FIG. 10.
Figure 18B:
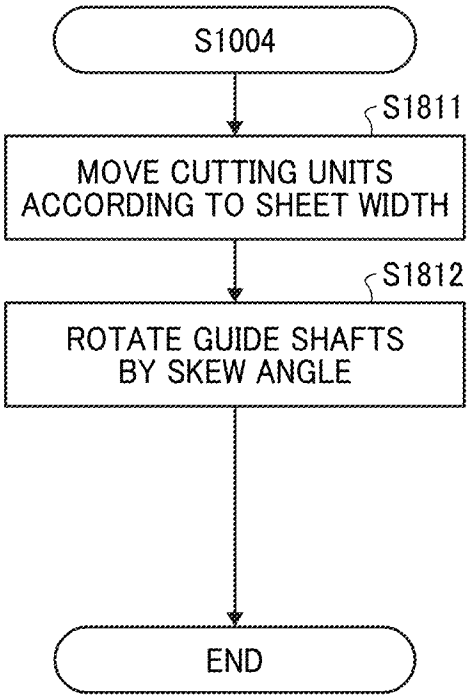
Figure 18C:
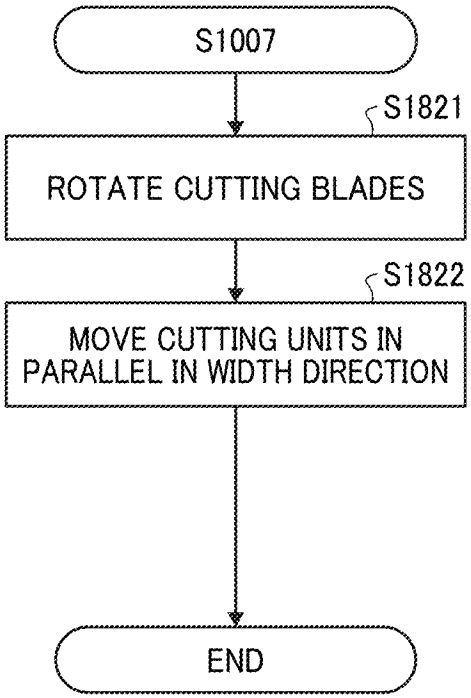

FIGS. 18A to 18C are flowcharts illustrating steps S1003, S1004, and S1007 according to the third embodiment of the chamfering process illustrated in FIG. 10. FIGS. 19A to 19F are diagrams illustrating a positional relationship between the sheet M and the cutting units 33*a* and 33*b* in each phase of a chamfering process according to the third embodiment. In the chamfering process according to the third embodiment, steps S1003, S1004, and S1007 are different from the first embodiment, and other steps S1001 and S1002, S1005 and S1006, and S1008 and S1009 are in common with the first embodiment.

In step S1003 of FIG. 10, a controller 100 according to the third embodiment executes steps S1801 to S1803 illustrated in FIG. 18A. In steps S1801 to S1803, the controller 100 determines the end face position of the sheet M at a plurality of locations separated in the conveyance direction, and detects the skew angle (tilt angle) θ of the sheet with respect to the conveyance direction based on the difference between the determined end face positions.

More particularly, as illustrated in FIG. 19A, the controller 100 determines the end face position of the sheet M based on the detection signal from a line sensor 23 at the timing when a first position on the front end side of the sheet M faces the line sensor 23 (S1801). Further, as illustrated in FIG. 19B, the controller 100 determines the end face position of the sheet M based on the detection signal from the line sensor 23 at the timing when a second position of the sheet M closer to the rear end side than the first position faces the line sensor 23 (S1802). The distance between the first position and the second position is determined by the number of pulse signals of the rotary encoder in the motor of the conveyance unit 21.

Next, the controller 100 determines the skew angle θ based on the combination of the difference between the end face positions (first length in the width direction) determined in steps S1801 and S1802 and the distance between the first position and the second position (second length in the conveyance direction) (S1803). More particularly, the skew angle θ refers to, in a right triangle whose two sides making a right angle have the first length and the second length, the angle formed by the side along the conveyance direction and the oblique side. The line sensor 23 and the rotary encoder in the motor of the conveyance unit 21 is an example of the tilt angle detector for detecting the skew angle θ of the sheet M with respect to the conveyance direction.

Further, in step S1004 of FIG. 10, the controller 100 according to the third embodiment executes steps S1811 and S1812 illustrated in FIG. 18B. In steps S1811 and S1812, the controller 100 has two cutting blades 43*a* facing the front right corner and the front left corner of the skewed sheet M.

First, as illustrated in FIG. 19C, the controller 100 moves the cutting units 33*a* and 33*b* according to the width of the sheet M by driving moving motors 34*a* and 34*b* (S1811). In step S1811, the moving motor 34*a* is driven assuming that the sheet M is not skewed. However, at this point, the cutting blades 43*a* of the cutting units 33*a* and 33*b* do not face the front right corner and the front left corner of the sheet M.

Next, as illustrated in FIG. 19D, the controller 100 drives the rotary motor 39 to rotate the guide shafts 32*a* and 32*b* by the skew angle θ (S1812). More particularly, the controller 100 rotates the guide shafts 32*a* and 32*b* by the skew angle θ in the same direction as the direction of tilt of the sheet M (counterclockwise in the example of FIGS. 19A to 19F) when the cutting device 30B is seen in a plan view. As a result, the cutting blades 43*a* of the cutting units 33*a* and 33*b* face the front right corner and the front left corner of the sheet M.

Further, in step S1007 of FIG. 10, the controller 100 according to the third embodiment executes steps S1821 and S1822 illustrated in FIG. 18C. In steps S1821 and S1822, the controller 100 has two cutting blades 43*a* facing the rear right corner and the rear left corner of the skewed sheet M.

First, as illustrated in FIG. 19E, by driving the switching motor 48, the controller 100 switches the cutting blade 43*a* of the cutting unit 33*a* from the first posture to the second posture and switches the cutting blade 43*a* of the cutting unit 33*b* from the third posture to the fourth posture (S1821). Further, the controller 100 moves the cutting units 33*a* and 33*b* by the first length by driving the moving motors 34*a* and 34*b* (S1822). The moving direction of the cutting units 33*a* and 33*b* is a direction from the end face position determined in step S1801 to the end face position determined in step S1802. As a result, the cutting blades 43*a* of the cutting units 33*a* and 33*b* face the rear right corner and the rear left corner of the sheet M.

According to the third embodiment, even when the sheet M is skewed, the four corners of the sheet M can be appropriately chamfered. Further, since the third embodiment is configured by adding only the rotary gear 38, the rotary motor 39, and the drive gear 39*a* to the cutting device 30 according to the first embodiment, the four corners of the skewed sheet M can be chamfered with the simple configuration.

Fourth Embodiment

Figure 20:
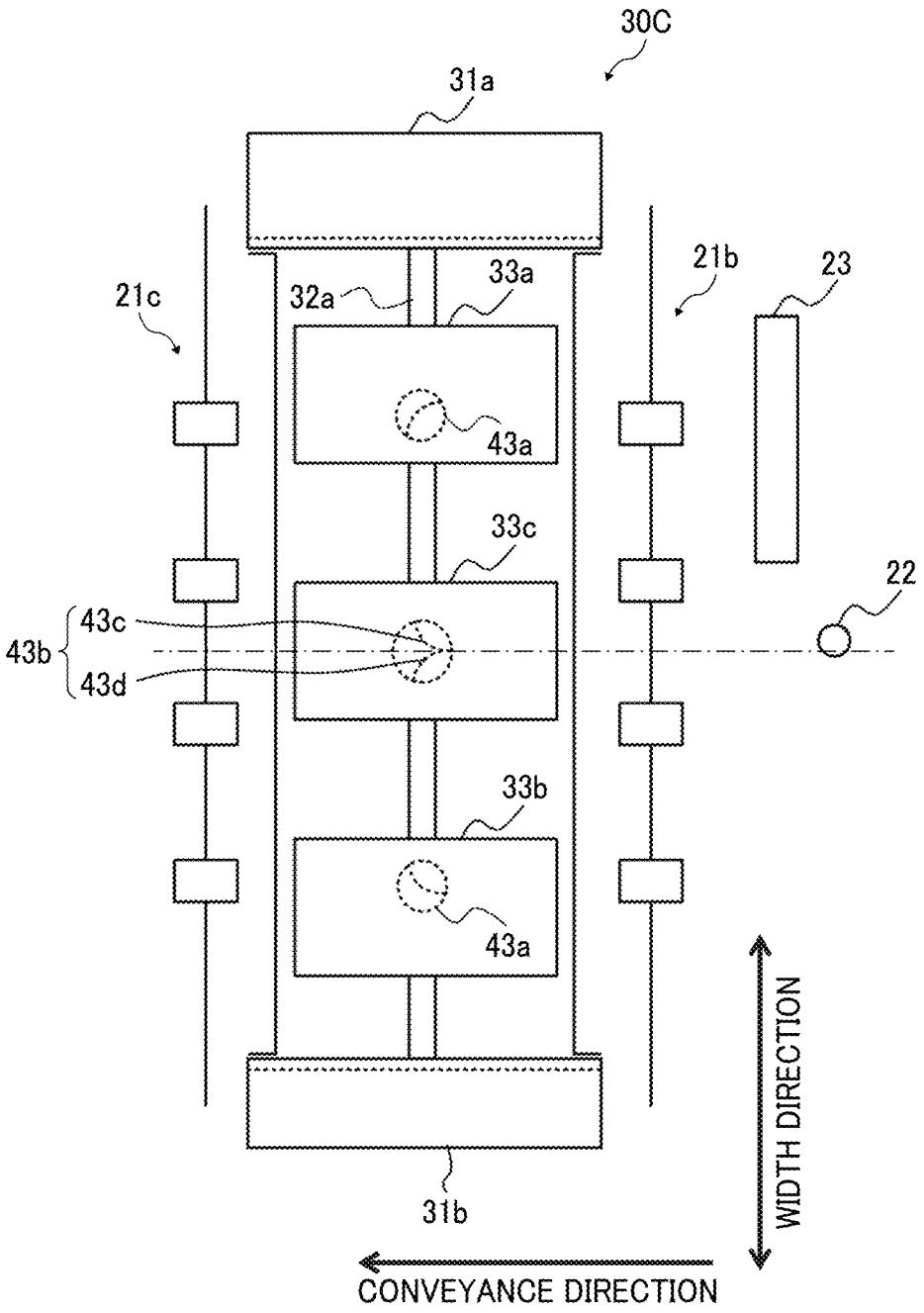
FIG. 20 is a plan view of a cutting device according to a fourth embodiment.

Next, a cutting device 30C according to a fourth embodiment will be described with reference to FIGS. 20 to 21C. FIG. 20 is a plan view of the cutting device 30C according to the fourth embodiment. FIGS. 21A to 21C are diagrams illustrating a positional relationship between a sheet M and cutting units 33*a*. 33*b*, and 33*c* in each phase of a chamfering process according to the fourth embodiment. The detailed description of points in common with the first embodiment will be omitted, and the differences will be mainly described.

The cutting device 30C according to the fourth embodiment is different from the first embodiment in including the three cutting units 33*a*, 33*b*, and 33*c*, and is the same as the first embodiment in other respects. The cutting unit 33*a* is arranged on one end (right end) side in the width direction, the cutting unit 33*b* is arranged on the other end (left end) side in the width direction, and the cutting unit 33*c* is arranged between the cutting units 33*a* and 33*b*.

The cutting blades 43*a* of the cutting units 33*a* and 33*b* each have a fan shape with a central angle of 90°. On the other hand, the cutting blade 43*b* of the cutting unit 33*c* has a shape with a combination of the first blade 43*c* and the second blade 43*d* in the shape of a fan-like arc with a central angle of 90°. More particularly, the first blade 43*c* and the second blade 43*d* form the cutting blade 43*b* with first ends in contact with each other and curved in opposite directions. The cutting blade 43*a* of the cutting unit 33*a* is an example of the first blade, the cutting blade 43*a* of the cutting unit 33*b* is an example of the second blade, and the cutting blade 43*b* of the cutting unit 33*c* is an example of the third blade.

A controller 100 according to the fourth embodiment executes the chamfering process illustrated in FIG. 10. However, the chamfering process according to the fourth embodiment differs from the first embodiment in steps S1004, S1005, S1007, and S1008 in the following points.

Figure 21A:
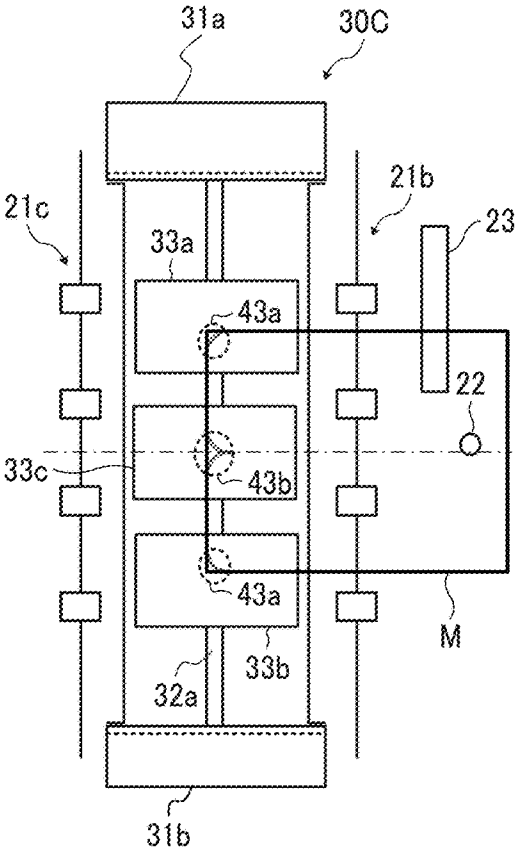
FIGS. 21A to 21C are diagrams illustrating a positional relationship between a sheet M and cutting units in each phase of a chamfering process according to the fourth embodiment.

First, in step S1004, the controller 100 causes the cutting blade 43*a* of the cutting unit 33*a* to face the front right corner of the sheet M, causes the cutting blade 43*a* of the cutting unit 33*b* to face the front left corner of the sheet M, and causes the cutting blade 43*b* of the cutting unit 33*c* to face the center of the front end of the sheet M, as illustrated in FIG. 21A. At this time, the cutting blade 43*a* of the cutting unit 33*a* is in the first posture, and the cutting blade 43*a* of the cutting unit 33*b* is in the third posture. The cutting blade 43*b* of the cutting unit 33*c* is in a fifth posture in which the first blade 43*c* is in the third posture and the second blade 43*d* is in the first posture.

Next, in step S1005, the controller 100 chamfers the front end of the sheet M at the three places by driving respective contact-and-separation motors 45 of the cutting units 33*a*, 33*b*, and 33*c*. When the sheet M is cut along a line extending in the conveyance direction through the center in the width direction, the chamfered portion in the center of the front end of the sheet M will form the front right corner and the front left corner of the two sheets after cutting.

Figure 21B:
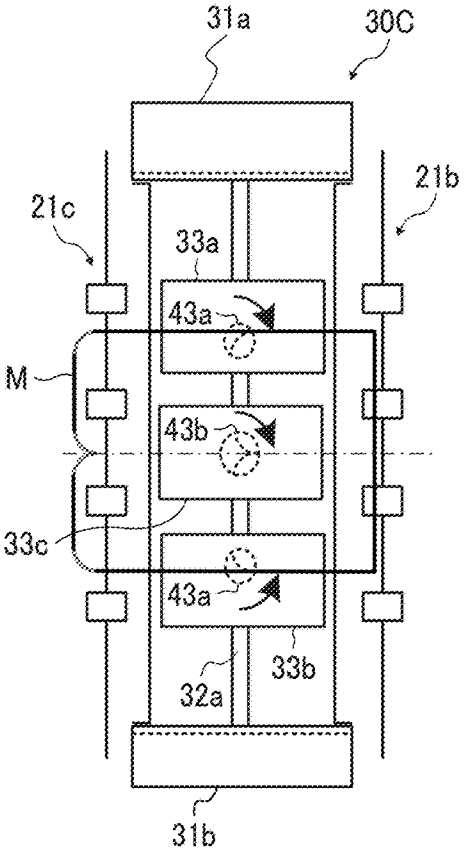

Next, in step S1007, as illustrated in FIG. 21B, by driving the switching motor 48, the controller 100 switches the cutting blade 43*a* of the cutting unit 33*a* from the first posture to the second posture, switches the cutting blade 43*a* of the cutting unit 33*b* from the third posture to the fourth posture, and switches the cutting blade 43*b* of the cutting unit 33*c* from the fifth posture to the sixth posture. The sixth posture is a posture in which the first blade 43*c* is in the fourth posture and the second blade 43*d* is in the second posture. That is, the controller 100 rotates the cutting blade 43*a* of the cutting unit 33*a* clockwise by 90°, rotates the cutting blade 43*a* of the cutting unit 33*b* counterclockwise by 90°, and rotates the cutting blade 43*b* of the cutting unit 33*c* by 180°.

Figure 21C:
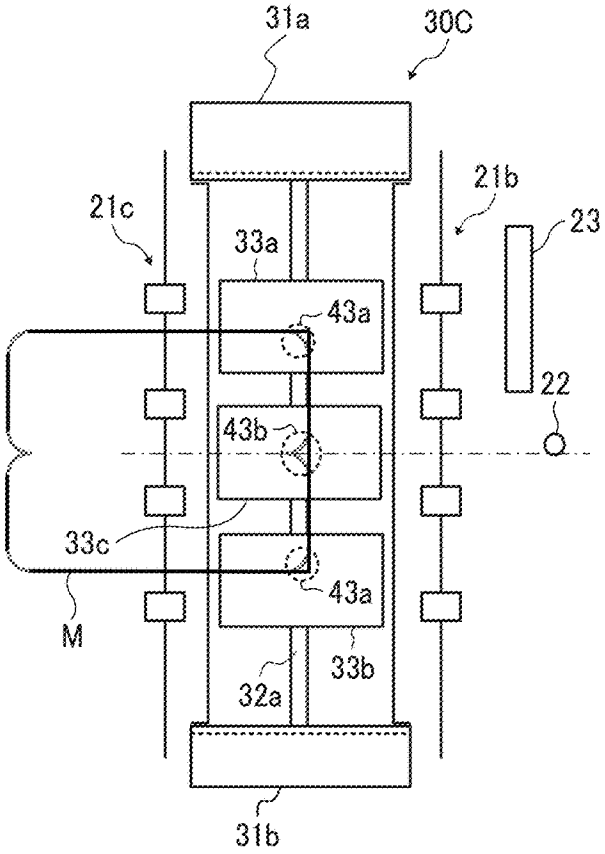

When step S1006 is executed, as illustrated in FIG. 21C, the cutting blade 43*a* of the cutting unit 33*a* faces the rear right corner of the sheet M, the cutting blade 43*a* of the cutting unit 33*b* faces the rear left corner of the sheet M. and the cutting blade 43*b* of the cutting unit 33*c* faces the center of the rear end of the sheet M.

Therefore, in step S1008, the controller 100 chamfers the rear end of the sheet M at the three places by driving the respective contact-and-separation motors 45 of the cutting units 33*a*, 33*b*, and 33*c*. When the sheet M is cut along a line extending in the conveyance direction through the center in the width direction, the chamfered portion in the center of the rear end of the sheet M will form the rear right corner and the rear left corner of the two sheets after cutting.

According to the fourth embodiment, not only the four corners of the sheet M but also the corners to be formed when the sheet M is subsequently cut can be chamfered in advance. Further, since the fourth embodiment is configured by adding only the cutting unit 33*c* to the cutting device 30 of the first embodiment, the above-mentioned processing can be implemented with the simple configuration.

Fifth Embodiment

Figure 22A:
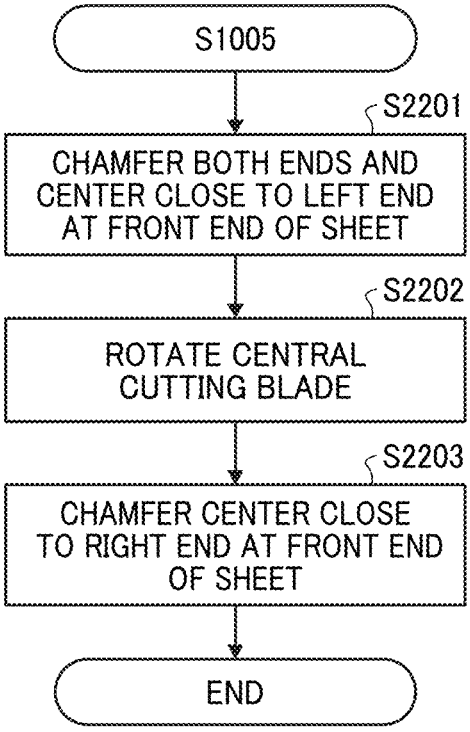
FIGS. 22A and 22B are flowcharts illustrating steps S1005 and S1008 according to a fifth embodiment of the chamfering process illustrated in FIG. 10.
Figure 22B:
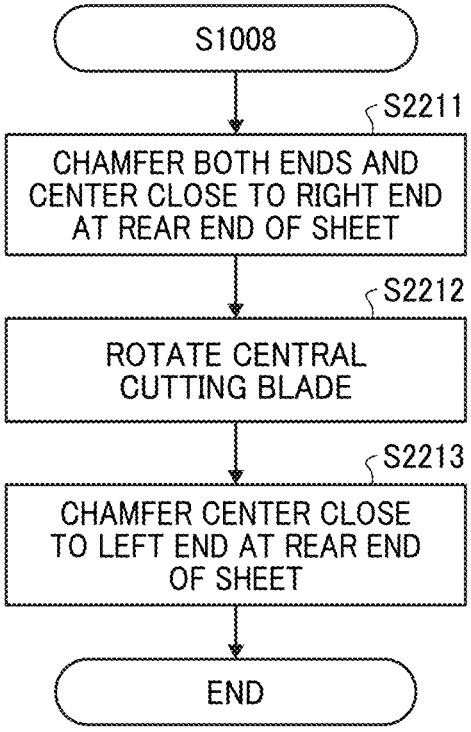

Next, a cutting device 30D according to a fifth embodiment will be described with reference to FIGS. 22A to 24D. FIGS. 22A and 22B are flowcharts illustrating steps S1005 and S1008 according to the fifth embodiment of the chamfering process illustrated in FIG. 10. FIGS. 23A to 23D are diagrams illustrating a positional relationship between a sheet M and cutting units 33*a*, 33*b*, and 33*d* in each phase of the chamfering process according to the fifth embodiment. FIGS. 24A to 24D are diagrams illustrating variations in the shape of a cutting blade 43*a*. The detailed description of points in common with the first and fourth embodiments will be omitted, and the differences will be mainly described.

As illustrated in FIGS. 23A to 23D, the cutting device 30D according to the fifth embodiment is different from the first embodiment in further including the cutting unit 33*d*. In addition, a cutting blade 43*a* of the cutting unit 33*d* according to the fifth embodiment is different from the fourth embodiment in that it has a fan shape with a central angle of 90°. That is, the cutting units 33*a*, 33*b*, and 33*d* according to the fifth embodiment include cutting blades 43*a* of the same shape.

In step S1005 of FIG. 10, a controller 100 according to the fifth embodiment executes steps S2201 to S2203 illustrated in FIG. 22A. At the timing when steps S1001 to S1004 in FIG. 10 are completed, the cutting blade 43*a* of the cutting unit 33*a* faces the front right corner of the sheet M and is in the first posture, the cutting blade 43*a* of the cutting unit 33*b* faces the front left corner of the sheet M and is in the third posture, and the cutting blade 43*a* of the cutting unit 33*d* faces the center of the front end of the sheet M and is in the first posture.

Figure 23A:
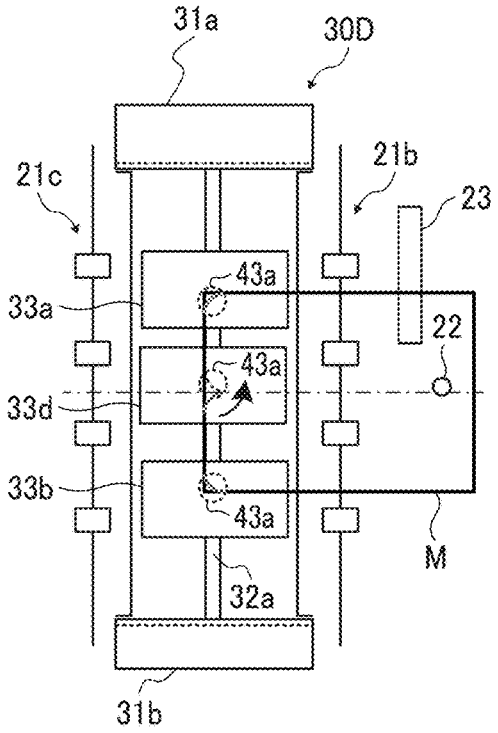
FIGS. 23A to 23D are diagrams illustrating a positional relationship between a sheet M and cutting units in each phase of the chamfering process according to the fifth embodiment.

First, as illustrated in FIG. 23A, by driving the contact-and-separation motors 45, the controller 100 chamfers the front right corner of the sheet M with the cutting blade 43*a* (first cutting blade) of the cutting unit 33*a*, chamfers the front left corner of the sheet M with the cutting blade 43*a* (second cutting blade) of the cutting unit 33*b*, and chamfers a vicinity of the center of the front end that is slightly close to the left end of the sheet M with the cutting blade 43*a* (third cutting blade) of the cutting unit 33*d* (S2201).

Figure 23B:
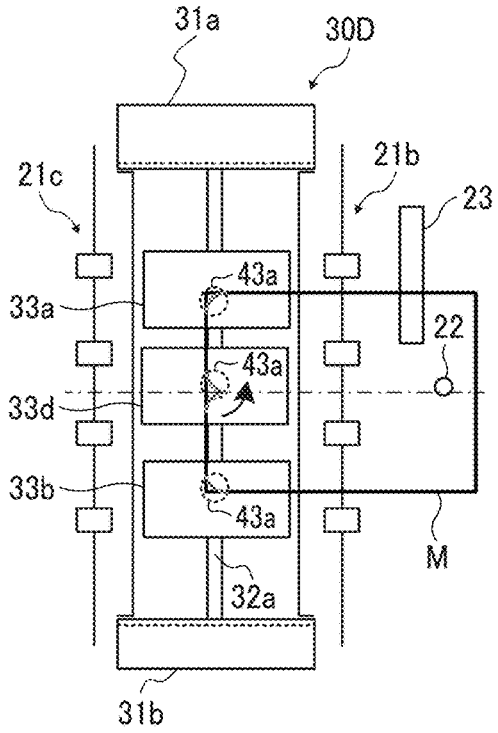

Next, as illustrated in FIG. 23B, the controller 100 switches the cutting blade 43*a* from the first posture to the third posture by driving the switching motor 48 of the cutting unit 33*d* (S2202). Then, the controller 100 chamfers a vicinity of the center of the front end that is slightly close to the right end of the sheet M with the cutting blade 43*a* by driving the contact-and-separation motor 45 of the cutting unit 33*d* (S2203).

Further, in step S1008 of FIG. 10, the controller 100 according to the fifth embodiment executes steps S2211 to S2213 illustrated in FIG. 22B. At the timing when steps S1006 and S1007 in FIG. 10 are completed, the cutting blade 43*a* of the cutting unit 33*a* faces the rear right corner of the sheet M and is in the second posture, the cutting blade 43*a* of the cutting unit 33*b* faces the rear left corner of the sheet M and is in the fourth posture, and the cutting blade 43*a* of the cutting unit 33*d* faces the center of the rear end of the sheet M and is in the fourth posture.

Figure 23C:
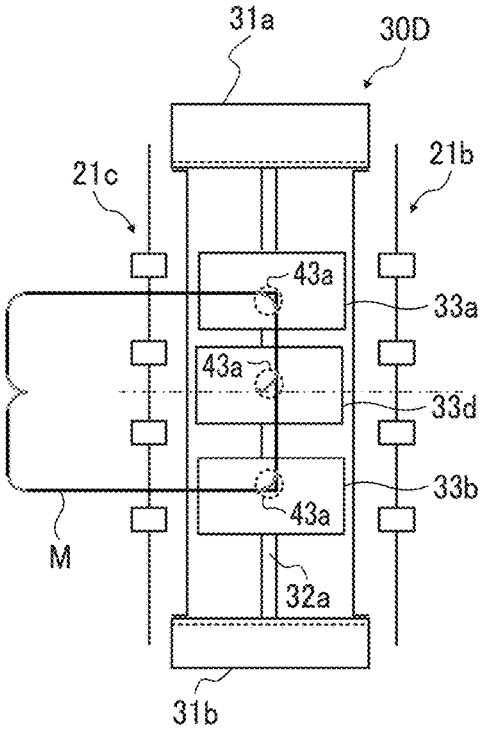

First, as illustrated in FIG. 23C, by driving the contact-and-separation motors 45, the controller 100 chamfers the rear right corner of the sheet M with the cutting blade 43*a* of the cutting unit 33*a*, chamfers the rear left corner of the sheet M with the cutting blade 43*a* of the cutting unit 33*b*, and chamfers a vicinity of the center of the rear end that is slightly close to the right end of the sheet M with the cutting blade 43*a* of the cutting unit 33*d* (S2211).

Figure 23D:
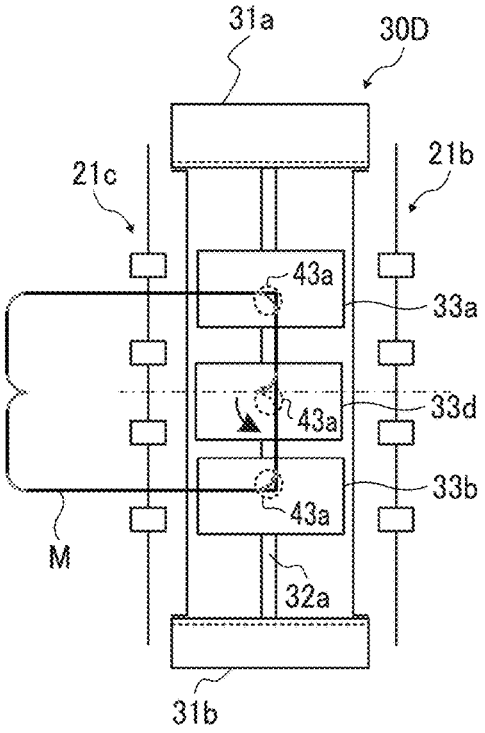

Next, as illustrated in FIG. 23D, the controller 100 switches the cutting blade 43*a* from the fourth posture to the second posture by driving the switching motor 48 of the cutting unit 33*d* (S2212). Then, the controller 100 chamfers a vicinity of the center of the rear end that is slightly close to the left end of the sheet M with the cutting blade 43*a* by driving the contact-and-separation motor 45 of the cutting unit 33*d* (S2213).

According to the fifth embodiment, as in the fourth embodiment, the corners to be formed when the sheet M is subsequently cut can be chamfered in advance. In the fifth embodiment, it is necessary to cut the center of the front end and the center of the rear end of the sheet M twice, which lowers the efficiency of the chamfering process as compared with the fourth embodiment. On the other hand, in the fifth embodiment, the cutting units 33*a*, 33*b*, and 33*d* can have the cutting blades 43*a* of the same shape, which decreases the number of parts as compared with the fourth embodiment.

Figure 24A:
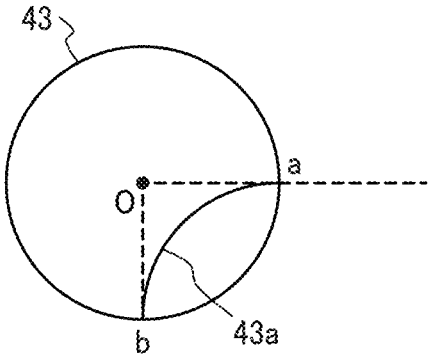
FIGS. 24A to 24D are diagrams illustrating variations in the shape of a cutting blade.
Figure 24B:
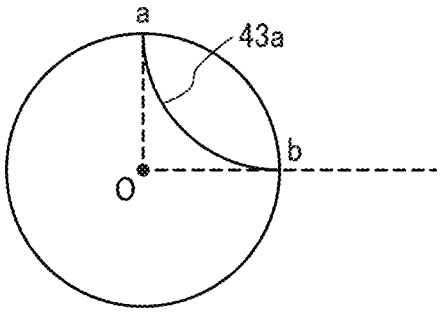

When the cutting blade 43*a* has the shape illustrated in FIG. 24A or 24B, the controller 100 does not need to move the cutting unit 33*d* in the width direction in steps S2202 and S2212. More particularly, each of the cutting blades 43*a* illustrated in FIGS. 24A and 24B has a shape in which both ends a and b are in contact with two virtual lines (dotted lines) that pass through a rotation center O of a blade body 43 and are orthogonal to each other on the outer peripheral surface of the blade body 43.

In this case, in step S2201, as illustrated in FIG. 24A, the controller 100 chamfers a vicinity of the center of the front end that is slightly close to the left end of the sheet M with an end portion a aligned with the center of the sheet M in the width direction. Next, in step S2202, the controller 100 only needs to rotate the cutting blade 43*a* clockwise by 90°. As a result, as illustrated in FIG. 24B, an end portion b of the cutting blade 43*a* aligns with the center of the sheet M in the width direction. Then, in step S2203, the controller 100 chamfers a vicinity of the center of the front end that is slightly close to the right end of the sheet M.

Figure 24C:
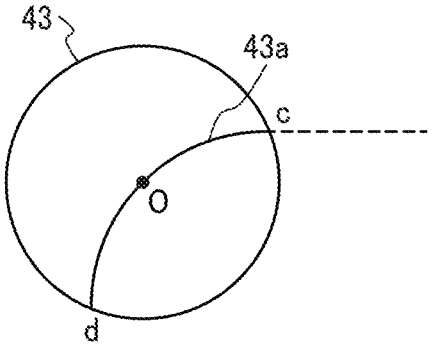
Figure 24D:
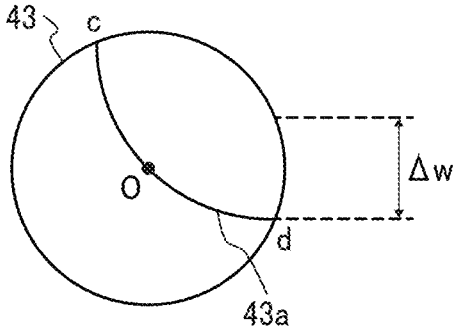

On the other hand, when the cutting blade 43*a* has the shape illustrated in FIG. 24C or 24D, the controller 100 needs to move the cutting unit 33*d* in the width direction in steps S2202 and S2212. More particularly, the cutting blades 43*a* illustrated in FIGS. 24C and 24D have shapes that pass through the rotation center O of the blade body 43.

In this case, in step S2201, as illustrated in FIG. 24C, the controller 100 chamfers a vicinity of the center of the front end that is slightly close to the left end of the sheet M with an end portion c aligned with the center of the sheet M in the width direction. Next, in step S2202, the controller 100 rotates the cutting blade 43*a* clockwise by 90°. At this time, as illustrated in FIG. 24D, an end portion d of the cutting blade 43*a* and the center of the sheet M in the width direction are misaligned by Δw. Therefore, in step S2202, the controller 100 further moves the cutting unit 33*d* by Δw in the width direction to align the end portion d of the cutting blade 43*a* with the center of the sheet M in the width direction. Then, in step S2203, the controller 100 chamfers a vicinity of the center of the front end that is slightly close to the right end of the sheet M.

With the shape of the cutting blade 43*a* illustrated in FIG. 24A or 24B, the movement of the cutting unit 33*d* in step S2202 can be omitted. On the other hand, the cutting blades 43*a* illustrated in FIGS. 24A and 24B need to have a larger diameter of the blade body 43 than the cutting blades 43*a* illustrated in FIGS. 24C and 24D. Steps S2211 to S2213 may be performed according to the above-mentioned process.

Sixth Embodiment

Figure 25:
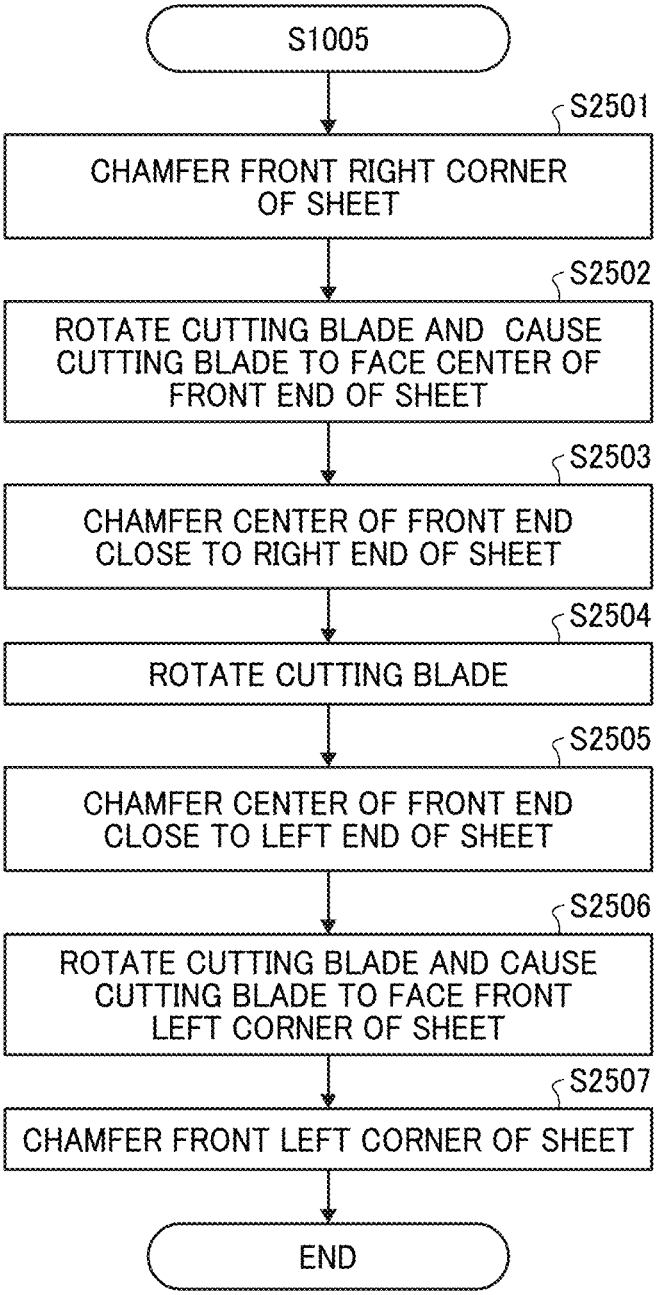
FIG. 25 is a flowchart illustrating step S1005 according to a sixth embodiment of the chamfering process illustrated in FIG. 10.

Next, a cutting device 30E according to a sixth embodiment will be described with reference to FIGS. 25 to 26D. FIG. 25 is a flowchart illustrating step S1005 according to the sixth embodiment of the chamfering process illustrated in FIG. 10. FIGS. 26A to 26D are diagrams illustrating a positional relationship between a sheet M and a cutting unit 33*a* in each phase of the chamfering process according to the sixth embodiment. The detailed description of points in common with the first, second, fourth, and fifth embodiments will be omitted, and the differences will be mainly described. The cutting device 30E according to the sixth embodiment includes only one cutting unit 33*a*, like the cutting device 30A according to the second embodiment.

In step S1005 of FIG. 10, a controller 100 according to the sixth embodiment executes steps S2501 to S2507 illustrated in FIG. 25. At the timing when steps S1001 to S1004 in FIG. 10 are completed, a cutting blade 43*a* of the cutting unit 33*a* faces the front right corner of the sheet M and is in the first posture.

Figure 26A:
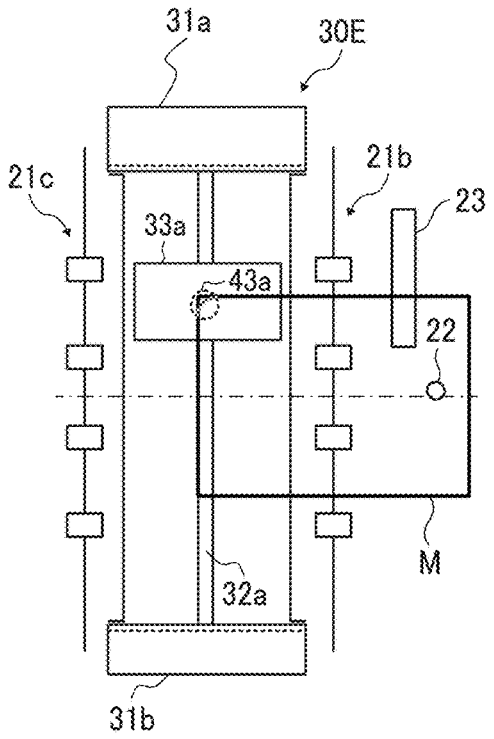
FIGS. 26A to 26D are diagrams illustrating a positional relationship between a sheet M and a cutting unit in each phase of the chamfering process according to the sixth embodiment. The accompanying drawings are intended to depict embodiments of the present disclosure and should not be interpreted to limit the scope thereof. The accompanying drawings are not to be considered as drawn to scale unless explicitly noted.
Figure 26B:
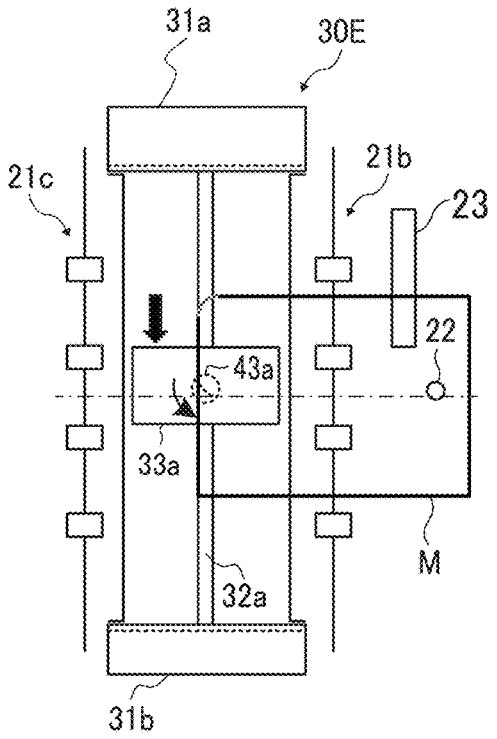

First, as illustrated in FIG. 26A, the controller 100 chamfers the front right corner of the sheet M with the cutting blade 43*a* by driving a contact-and-separation motor 45 (S2501). Next, as illustrated in FIG. 26B, the controller 100 switches the cutting blade 43*a* from the first posture to the third posture by driving a switching motor 48, and moves the cutting unit 33*a* to a position where the cutting blade 43*a* faces the center of the front end of the sheet M by driving a moving motor 34*a* (S2502).

Figure 26C:
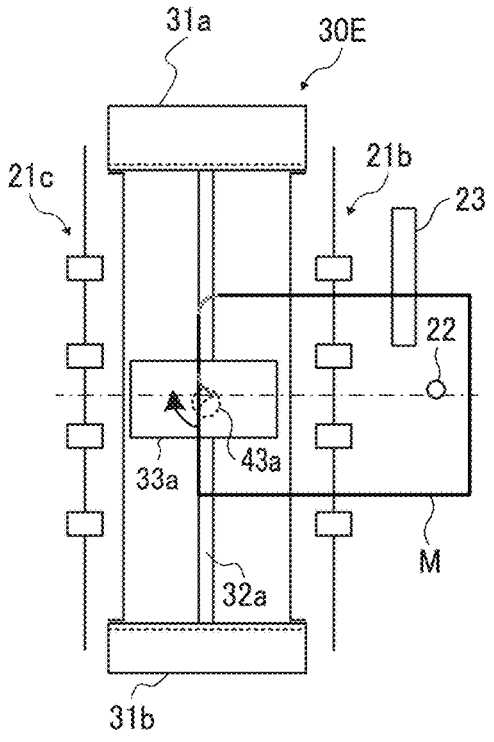
Figure 26D:
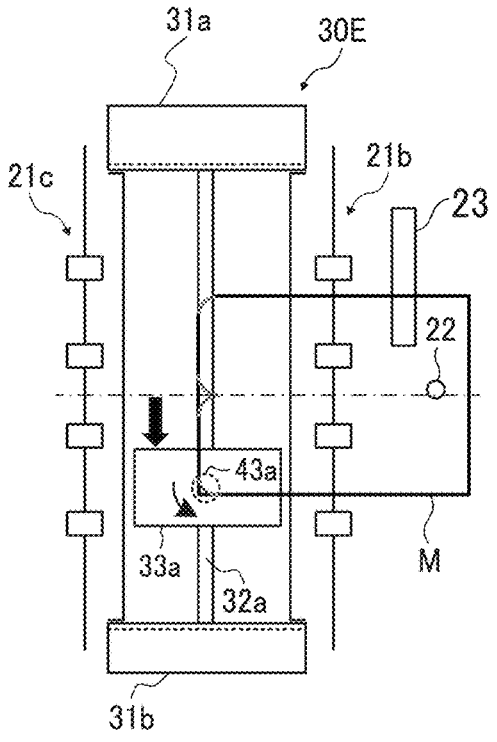

Next, the controller 100 chamfers a vicinity of the center of the front end that is slightly close to the right end of the sheet M with the cutting blade 43*a* by driving the contact-and-separation motor 45 (S2503). Next, as illustrated in FIG. 26C, the controller 100 switches the cutting blade 43*a* from the third posture to the first posture by driving the switching motor 48 (S2504). Next, the controller 100 chamfers a vicinity of the center of the front end that is slightly close to the left end of the sheet M with the cutting blade 43*a* by driving the contact-and-separation motor 45 (S2505).

Next, as illustrated in FIG. 26D, the controller 100 switches the cutting blade 43*a* from the first posture to the third posture by driving the switching motor 48, and moves the cutting unit 33*a* to a position where the cutting blade 43*a* faces the front left corner of the sheet M by driving the moving motor 34*a* (S2506). Next, the controller 100 chamfers the front left corner of the sheet M with the cutting blade 43*a* by driving the contact-and-separation motor 45 (S2507).

In step S1008 of FIG. 10, the controller 100 according to the sixth embodiment executes steps S2501 to S2507 illustrated in FIG. 25 in the reverse order. That is, the controller 100 chamfers the rear end of the sheet M in the order of the rear left corner, a vicinity of the center slightly close to the left end, a vicinity of the center slightly close to the right end, and the rear right corner.

According to the sixth embodiment, the efficiency of the chamfering process is lower than that of the fourth and fifth embodiments, but the same function can be exhibited with the simpler configuration.

Note that the present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A cutting device configured to cut, in an arc shape, an end of a sheet conveyed in a conveyance direction, the cutting device comprising:

a first cutting blade, the first cutting blade having an arc-shape;

a switching mechanism configured to switch a posture of the first cutting blade in accordance with a position of the sheet facing the first cutting blade;

a contact-and-separation mechanism configured to bring the first cutting blade into contact with the sheet in a contact direction orthogonal to a surface of the sheet and away from the sheet in a separation direction opposite the contact direction, to cut the end of the sheet in the arc shape; and a receiving plate supported by an elastic member, the contact-and separation mechanism configured to bring the first cutting blade into contact with the receiving plate and elastically compress the elastic member.

2. The cutting device according to claim 1, wherein the switching mechanism is configured to rotate the first cutting blade around a rotation axis extending in the contact direction.

3. The cutting device according to claim 2, further comprising:

the first cutting blade positioned on one end side in a width direction orthogonal to the conveyance direction, the contact direction, and the separation direction; and a second cutting blade positioned on another end side in the width direction, wherein the first cutting blade has a fan shape with a central angle of 90° and is switchable between a first posture to chamfer, in an arc shape, a corner of a front end of the sheet in the conveyance direction on the one end side and a second posture to chamfer, in an arc shape, a corner of a rear end of the sheet in the conveyance direction on the one end side, and the second cutting blade has a fan shape with a central angle of 90° and is switchable between a third posture to chamfer, in an arc shape, a corner of the front end of the sheet on said another end side and a fourth posture to chamfer, in an arc shape, a corner of the rear end of the sheet on said another end side.

4. The cutting device according to claim 3, further comprising a third cutting blade positioned between the first cutting blade and the second cutting blade and having a fan shape with a central angle of 90°, wherein the third cutting blade is switchable among:

a first posture, identical to the first posture of the first cutting blade, in which the third cutting blade chamfers a vicinity of a center of the front end that is slightly close to said another end side of the sheet;

a second posture, identical to the second posture of the first cutting blade, in which the third cutting blade chamfers a vicinity of a center of the rear end that is slightly close to said another end side of the sheet;

a third posture, identical to the third posture of the second cutting blade, in which the third cutting blade chamfers a vicinity of the center of the front end that is slightly close to the one end side of the sheet; and a fourth posture, identical to the fourth posture of the second cutting blade, in which the third cutting blade chamfers a vicinity of the center of the rear end that is slightly close to the one end side of the sheet.

5. The cutting device according to claim 3, further comprising a third cutting blade positioned between the first cutting blade and the second cutting blade, the third cutting blade including a first blade of a fan shape with a central angle of 90° and a second blade of a fan shape with a central angle of 90°, wherein the third cutting blade has a shape in which one end of the fan shape the first blade and one end of the fan shape of the second blade contact each other and the fan shape of the first blade and the fan shape of the second blade are curved in opposite directions, and the third cutting blade is switchable between a fifth posture in which the first blade is in a posture identical to the third posture of the second cutting blade and the second blade is in a posture identical to the first posture of the first cutting blade to chamfer a center of the front end of the sheet and a sixth posture in which the first blade is in a posture identical to the fourth posture of the second cutting blade and the second blade is in a posture identical to the second posture of the first cutting blade to chamfer the center of the rear end of the sheet.

6. The cutting device according to claim 2, wherein the switching mechanism includes:

a switching motor;

a rotary gear configured to rotate around a rotation axis extending in the contact direction; and a pin configured to cause the first cutting blade inserted into the rotary gear to integrate with the rotary gear.

7. The cutting device according to claim 1, wherein the contact-and-separation mechanism includes:

a contact-and-separation motor;

a cam configured to rotate with a transferred driving force of the contact-and-separation motor; and a cam guide configured to, while supporting the first cutting blade, reciprocate in the contact direction and the separation direction along with rotation of the cam.

8. The cutting device according to claim 1, further comprising:

a cutting unit holding the first cutting blade, the switching mechanism, and the contact-and-separation mechanism;

a guide shaft supporting the cutting unit and extending in a width direction orthogonal to the conveyance direction, the contact direction, and the separation direction; and a moving mechanism configured to move the cutting unit along the guide shaft.

9. The cutting device according to claim 8, wherein the guide shaft supports a plurality of cutting units, including the cutting unit, at positions spaced apart in the width direction, and the moving mechanism is configured to independently move the plurality of cutting units.

10. The cutting device according to claim 8, further comprising a rotating mechanism configured to rotate the guide shaft on one end of the guide shaft on a plane parallel to the conveyance direction and the width direction.

11. A post-processing apparatus comprising:

a conveyor configured to convey a sheet in a conveyance direction;

the cutting device according to claim 2, configured to cut, in the arc shape, an end of the sheet conveyed by the conveyor;

a sheet position detector configured to detect a position of the sheet conveyed by the conveyor;

a rotation angle detector configured to detect a rotation angle of the first cutting blade; and control circuitry configured to control an operation of the cutting device based on a detection result of the rotation angle detector and a detection result of the sheet position detector, wherein the control circuitry is configured to:

cause the conveyor to convey the sheet, based on the detection result of the sheet position detector, such that a cutting position of the sheet faces the first cutting blade; and cause the switching mechanism to switch a posture of the first cutting blade, based on the detection result of the rotation angle detector, such that the first cutting blade is in a posture corresponding to the cutting position, and cause the contact-and-separation mechanism to bring the first cutting blade in the posture corresponding to the cutting position into contact with and away from the sheet.

12. The post-processing apparatus according to claim 11, wherein the control circuitry is configured to:

cause the conveyor to convey the sheet such that a corner on a front end side of the sheet in the conveyance direction faces the first cutting blade;

cause the contact-and-separation mechanism to bring the first cutting blade in a posture corresponding to the corner on the front end side of the sheet into contact with and away from the sheet;

cause the conveyor to convey the sheet such that a corner on a rear end side of the sheet in the conveyance direction faces the first cutting blade;

cause the switching mechanism to switch the posture of the first cutting blade such that the posture corresponds to the corner on the rear end side of the sheet; and cause the contact-and-separation mechanism to bring the first cutting blade in the posture corresponding to the corner on the rear end side of the sheet into contact with and away from the sheet.

13. A post-processing apparatus comprising:

a conveyor configured to convey a sheet in a conveyance direction;

the cutting device according to claim 10, configured to cut, in the arc shape, an end of the sheet conveyed by the conveyor;

a tilt angle detector configured to detect a tilt angle of the sheet with respect to the conveyance direction; and control circuitry configured to control an operation of the cutting device based on a detection result of the tilt angle detector, wherein the control circuitry is configured to cause the rotating mechanism to rotate the guide shaft by the tilt angle detected by the tilt angle detector.

14. An image forming system comprising:

an image forming apparatus configured to form an image on a sheet;

a conveyor configured to convey the sheet with the image formed by the image forming apparatus in a conveyance direction; and a post-processing apparatus including the cutting device according to claim 1.

15. The cutting device according to claim 1, further comprising a rotation sensor configured to determine an orientation of the first cutting blade.

16. The cutting device according to claim 15, wherein the rotation sensor includes a light emitting unit, a light receiving unit and a shielding plate.

* * * * *